US006382473B1

(12) United States Patent
Mekata et al.

(10) Patent No.: US 6,382,473 B1
(45) Date of Patent: May 7, 2002

(54) DEGASIFICATION INDICATION STRUCTURE OF AEROSOL CONTAINER, METHOD OF INDICATING DEGASIFICATION, AND DEGASIFICATION DEVICE

(75) Inventors: Satoshi Mekata, Ibaraki; Kouji Nomiyama, Ageo, both of (JP)

(73) Assignee: Osaka Shipbuilding Co., Ltd. (JP)

( * ) Notice: Subject to any disclaimer, the term of this patent is extended or adjusted under 35 U.S.C. 154(b) by 0 days.

(21) Appl. No.: 09/786,528

(22) PCT Filed: May 30, 2000

(86) PCT No.: PCT/JP00/03464

§ 371 Date: Mar. 2, 2001

§ 102(e) Date: Mar. 2, 2001

(87) PCT Pub. No.: WO01/04021

PCT Pub. Date: Jan. 18, 2001

(30) Foreign Application Priority Data

| | | |
|---|---|---|
| Jul. 8, 1999 | (JP) | 11-194803 |
| Oct. 14, 1999 | (JP) | 11-292692 |
| Mar. 3, 2000 | (JP) | 2000-058809 |

(51) Int. Cl.[7] ..... B65D 83/00
(52) U.S. Cl. ..... 222/402.14

(58) Field of Search ..... 222/402.1, 402.14, 222/402.13; 137/557

(56) References Cited

U.S. PATENT DOCUMENTS

| | | | | |
|---|---|---|---|---|
| 4,277,004 A | * | 7/1981 | Barlics | 222/402.14 |
| 4,426,025 A | | 1/1984 | Knickerbocker | 222/182 |
| 4,577,803 A | | 3/1986 | Owen | 239/690 |
| 6,000,579 A | | 12/1999 | Sugimoto et al. | 222/108 |
| 6,021,927 A | * | 2/2000 | Nomiyama et al. | 222/402.14 |

FOREIGN PATENT DOCUMENTS

| | | |
|---|---|---|
| JP | 5139469 | 6/1993 |
| JP | 10264958 | 10/1998 |

* cited by examiner

*Primary Examiner*—Philippe Derakshani
*Assistant Examiner*—Thach H Bui
(74) *Attorney, Agent, or Firm*—Ware, Fressola, Van Der Sluys & Adolphson LLP

(57) ABSTRACT

A degassing tool or a part thereof is attached to a degassed aerosol container such that a stem of the aerosol container is maintained in a pressed condition, and it is indicated on an outer surface of the degassing tool or the part thereof that degassing has been completed. Everybody can identify that the aerosol container is in a degassed condition even though degassing has been performed without forming any holes on the aerosol container itself.

26 Claims, 32 Drawing Sheets

DEGASIFICATION INDICATION STRUCTURE OF AEROSOL CONTAINER, METHOD OF INDICATING DEGASIFICATION, AND DEGASIFICATION DEVICE

TECHNICAL FIELD

The present invention relates to an arrangement for indicating a degassed condition of an aerosol container, a method for indicating a degassed condition and a degassing tool suitably used therewith with which everybody can apparently identify that the aerosol container is in a degassed condition.

BACKGROUND ART

Flon gas is being replaced by combustible liquid petroleum gas (LPG) for use as filled gas (aerosol gas) in aerosol containers in view of problems of environmental influences, and accompanying such changes, the number of accidents, particularly fires of garbage trucks, has increased of which reasons are considered to be gas remaining in wasted aerosol containers. It has thus been conventionally instructed through Cleaning Departments of respective Self-governing Bodies "to completely discharge filled gas (aerosol gas) by forming holes on containers when disposing of aerosol containers".

However, accidents repeatedly happened in which containers exploded when consumers tried to form holes thereon so that it is recently being instructed "to dispose of containers without forming holes but after using the contents up" (see Nihon Keizai Shinbum of Jun. 3, 1999).

Various types of degassing tools arranged for easily spraying out the entire aerosol gas containers without forming holes on aerosol containers are conventionally known. Reference might be made, for instance, to Japanese Unexamined Patent Publication No. 324661/1996, Japanese Unexamined Patent Publication No. 53289/1998 or Japanese Unexamined Patent Publication No. 118098/1999.

However, while dangers occurring at the time of forming holes in containers are eliminated when degassing aerosol containers by using such degassing tools, it is impossible, on the other hand, to identify at a glance whether such containers really been degassed or not since holes are not made in the containers. While many persons engaged in the cleaning or garbage-collecting business confirm whether residues of aerosol contents are present or not by shaking discarded containers, it is the case with many aerosol containers such as those for insecticides that the contents (fluid) remain somewhat even after complete discharge of filled gas (aerosol gas) (dangers of explosion do not exist in case gas is completely discharged), so that it cannot be identified whether containers have been degassed or not after all. Consequently, persons engaged in the cleaning or garbage-collecting business will not collect discarded aerosol containers, considering that these containers have contents remaining though actually being degassed.

The present invention thus aims to provide an arrangement for indicating a degassed condition of an aerosol container, a method for indicating a degassed condition and a degassing tool suitably used therewith with which everybody can identify that the aerosol container is in a degassed condition even though degassing has been performed without forming any holes.

DISCLOSURE OF INVENTION

For achieving the above objects, the arrangement for indicating a degassed condition of an aerosol container according to the present invention is so arranged that a degassing tool or a part thereof is attached to a degassed aerosol container such that a stem of the aerosol container is maintained in a pressed condition and that it is indicated on an outer surface of the degassing tool or the part thereof that degassing has been completed.

This arrangement for indicating a degassed condition of an aerosol container might, for instance, be so arranged that a degassing tool with an indication denoting a degassed condition on an outer surface thereof is attached to an aerosol container and degassing is performed by maintaining a stem thereof in a pressed condition, and that the degassing tool is maintained in the attached condition also upon completion of degassing, wherein there can be suitably employed a degassing tool with which the aerosol container can be maintained in a spraying condition when the tool is attached to the aerosol container, the tool having an indication denoting a degassed condition on a portion constituting the outer surface when the tool is attached to the aerosol container.

According to the above-described arrangement for indicating a degassed condition of an aerosol container, the method for indicating a degassed condition and the degassing tool, it is possible to indicate that the aerosol container is in a degassed condition by simply maintaining the degassing tool or a part thereof at the container also upon completion of degassing, and it is possible for everybody to identify at a glance that the container has been degassed. Since persons engaged in the cleaning or garbage-collecting business can also easily identify that the aerosol container is in a degassed condition, such persons might collect these aerosol containers in a carefree manner as posing no danger of explosion or fire.

The "part of the degassing tool" or "a portion including the indication denoting a degassed condition" of the above-described arrangement for indicating a degassed condition might, for instance, be arranged to be separable from the degassing tool, and upon completion of degassing, one part of the degassing tool is separated while the remaining part of the degassing tool is maintained attached to the aerosol container whereby it is possible to indicate by the indication on the outer surface of this part of the degassing tool that degassing has been performed.

With this arrangement, the degassing tool (the portion including the indication denoting a degassed condition) is enabled to assume a more smaller and compact size and can be quite conveniently collected and stored without being bulky.

For arranging a part of the degassing tool in a separable manner, a cutting preparatory line such as a perforation or a thin portion might be formed to surround or constitute the portion to be separated such that this portion can be easily separated.

The "degassing tool or a part thereof including the indication denoting a degassed condition" of the arrangement for indicating a degassed condition, that is, the part of or the entire degassing tool which is ultimately attached to the aerosol container is preferably formed of a material of the same discard group as that of the aerosol container. In this manner, the entire aerosol container with the degassing tool being attached thereto is formed of a material of the same discard group to be favorable in view of discrete collection of garbage for purposes of seregation into groups and might be forwarded to subsequent treatments (e.g. recycling treatments) without the need of discretion after collection.

The term "material of the same group as that of the aerosol container" indicates that the material should be of a group that no inconveniences are caused at the time of collecting garbage, particularly discrete collection thereof; in case the aerosol container is, for instance, made of aluminum, the tool should be of metallic material, preferably light metallic material, and most preferably of aluminum material. In case a part of the degassing tool (portion indicating a degassed condition) is made of aluminum and the remaining portions of the degassing tool is made by injection molding of plastic, it is possible to perform, for instance, the following steps: the portion indicating a degassed condition made of aluminum is preliminarily fitted into an injection mold when performing injection of plastic, aluminum and plastic are integrally formed, and a cutting preparatory line such as a perforation is formed as to surround the portion indicating a degassed condition made of aluminum thereafter.

It should be noted that in case of forming the degassing tool of synthetic resin, it is preferable to use biodegradable plastic in view of compatibility with the environment. Examples of such biodegradable plastics are aliphatic polyester such as polylactic acid, polycaprolactone, polybutylene succinate, polyethylene succinate or polyglycol acid, polyvinyl alcohol, polyamino acid groups, biopolyester, bacteria cellulose, starch, and cellulose acetate. However, the synthetic resin for use in forming degassing tools is not limited to the above biodegradable plastic.

In the arrangement for indicating a degassed condition, a method for indicating a degassed condition and a degassing tool of the present invention, it is preferable to maintain the stem in the pressed condition also upon completion of degassing by maintaining the degassing tool or a part of the degassing tool attached to the aerosol container. The degassing tool is preferably arranged that the portion with the indication denoting a degassed condition includes an engaging portion and a gas spraying hole for maintaining the stem in the pressed condition when the tool is attached to the aerosol container. This is due to the fact that the danger of explosion can be more reliably eliminated since the interior of the container is maintained in an open condition when the aerosol container is discarded with the stem being maintained in the pressed condition, that is, in a gas spraying condition. This further enables it to confirm that the container is in a degassed condition not only through the indication denoting a degassed condition but also through its actual appearance, and persons engaged in the cleaning or garbage-collecting business might collect such aerosol containers in an even more carefree manner.

In the present invention, the arrangement for indicating a degassed condition of an aerosol container is also obtained by engaging and attaching an indicating body with an indication denoting a degassed condition to the aerosol container in a degassed condition.

This arrangement for indicating a degassed condition of an aerosol container might be so configured that an indicating body with an indication denoting a degassed condition is attached to the degassing tool in a separable manner, that the indicating body is engaged and attached to the aerosol container simultaneously with performing degassing of the aerosol container by using the degassing tool, and that the degassing tool is separated from the aerosol container upon completion of degassing and a degassed condition is indicated by the indicating body engaged at the aerosol container.

It should be noted that in the arrangement for indicating a degassed condition, the method for indicating a degassed condition and the degassing tool of the present invention, the form of the "degassing tool" is not particularly limited and also includes a degassing tool concurrently used as aerosol cap which might be used as an aerosol cap in normal conditions and as a degassing tool when turning the same upside down. The style, expression or design of an "indication denoting a degassed condition" is arbitrary so long as it is capable of informing a degassed condition. While it is of course possible to express this purport in letters, colors or designs might, for instance, be indicated in case it can be recognized or it has been agreed upon that certain colors or designs indicate a degassed condition.

On the other hand, the present invention also provides a degassing tool for an aerosol container in which the degassing tool includes an engaging portion with which a stem can be maintained in a pressed condition at the time the tool is engaged with an aerosol container, and a gas spraying hole, and the aerosol container being maintained in a spraying condition when the tool is attached to the aerosol container, wherein a cutting preparatory line is formed to surround the engaging portion to enable at least a portion including the engaging portion to be separable from a degassing tool main body. While this degassing tool does not have an indication denoting a degassed condition, it is apparent to everybody that the container is in a degassed condition with the separating body being attached to the container. Thus, it is possible to inform a degassed condition of the container by separating the portion surrounded by the cutting preparatory line (cutoff body) upon completion of degassing and by keeping the cutoff body attached to the aerosol container to be discarded. Moreover, since it is also possible to know that the stem is maintained in a pressed condition and the interior and exterior of the container are maintained in a communicated condition, it is possible for everybody including persons engaged in the cleaning and garbage-collecting business to visually confirm the arrangement of a degassed condition with one's own eyes.

BEST MODE FOR CARRYING OUT THE INVENTION

Forms for embodying the present invention will now be explained based on several embodiments thereof .

Embodiment 1

Figure 1:
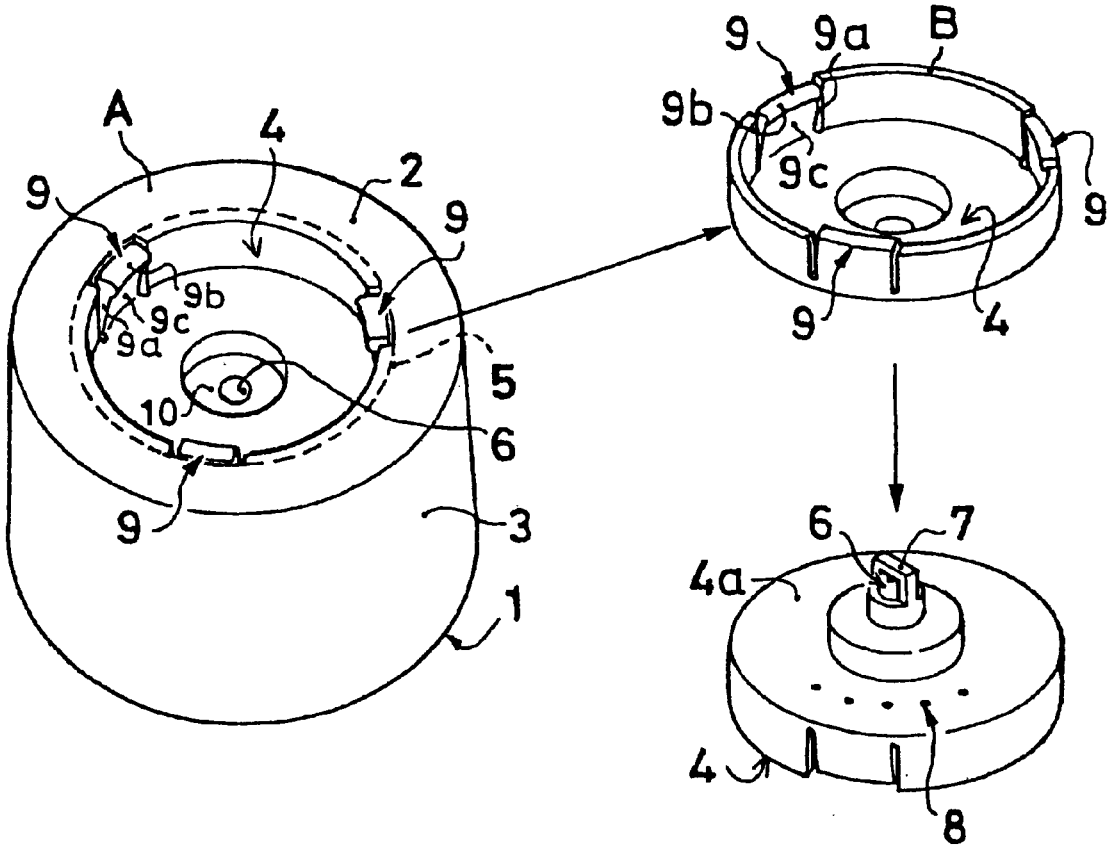
FIG. 1 is a perspective view showing a degassing tool and, a front surface side and a rear surface side of a part of the degassing tool which is separated therefrom, that is, a cutoff body, according to one embodiment of the present invention.
Figure 2:
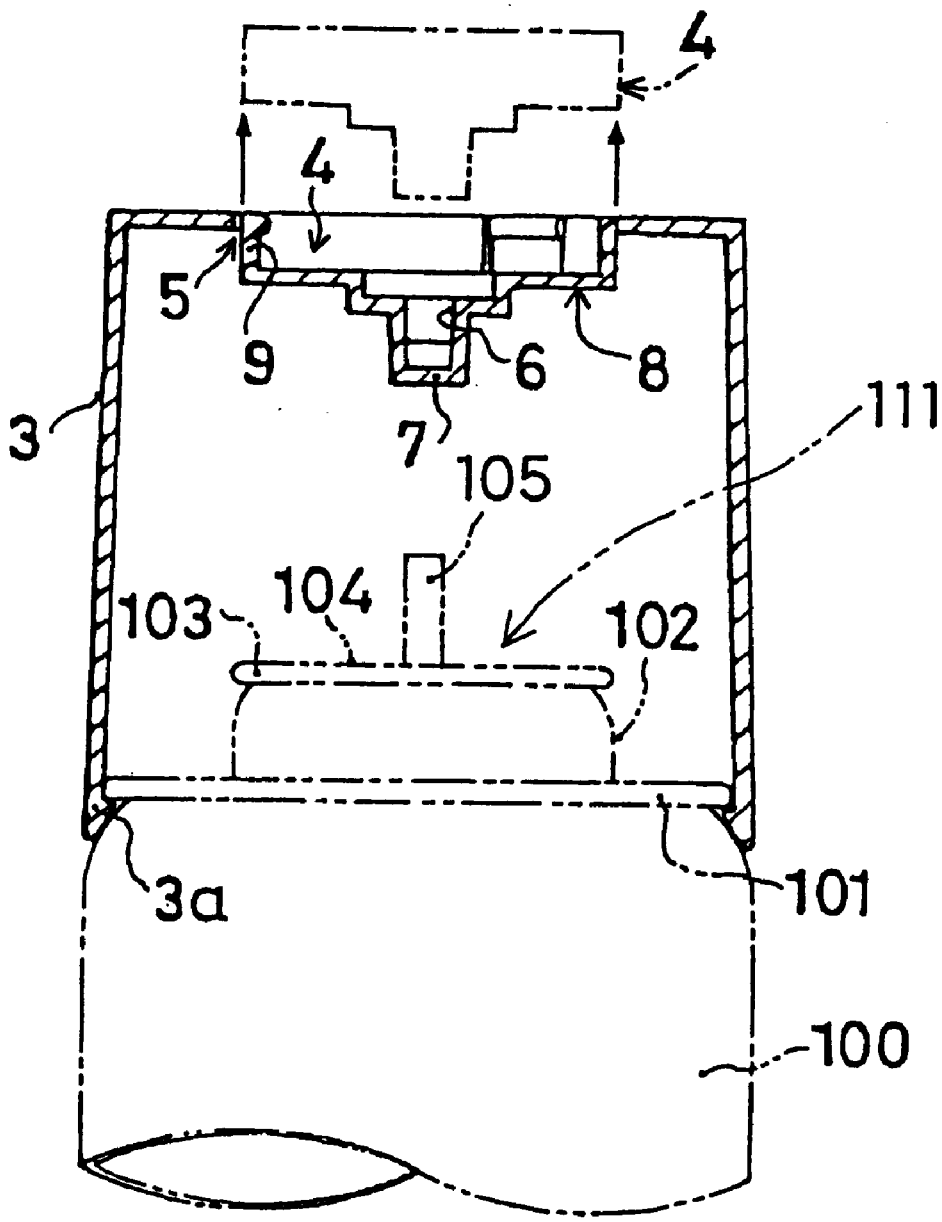
FIG. 2 is a longitudinal sectional view of the degassing tool of FIG. 1.
Figure 3:
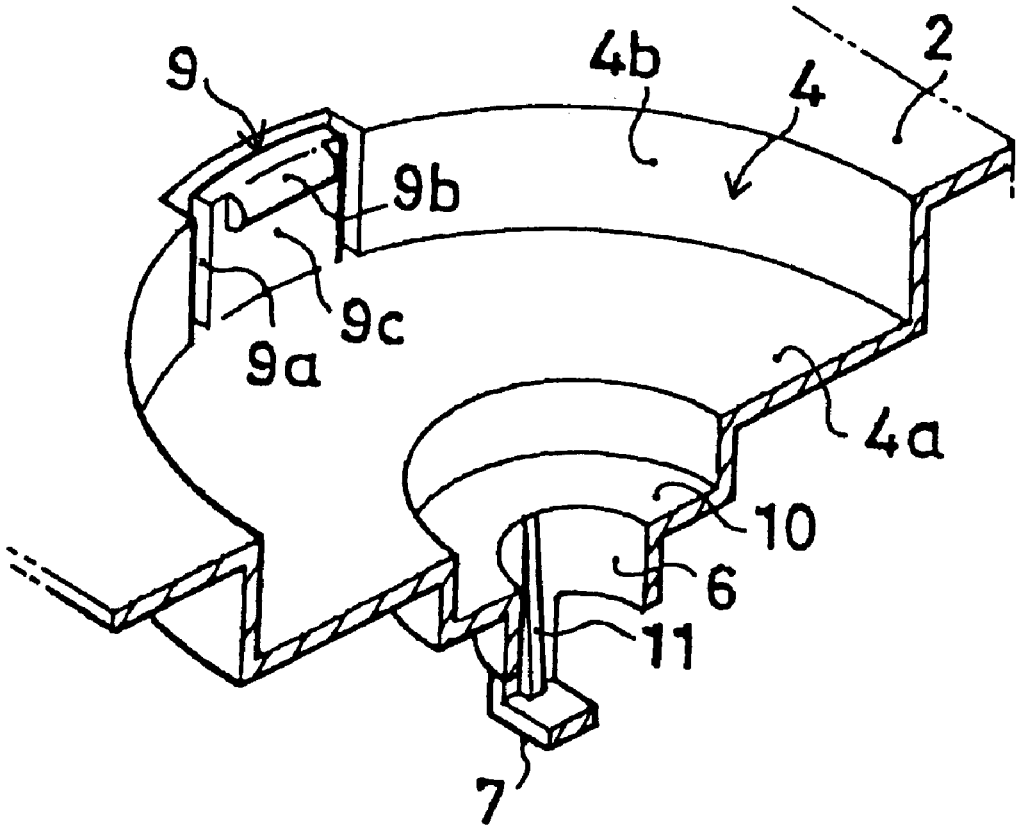
FIG. 3 is a partial, sectional perspective view of a main portion of an arrangement of spraying outlet sides of an engaging through hole of the degassing tool of FIG. 1 seen from inside of a cap.
Figure 4:
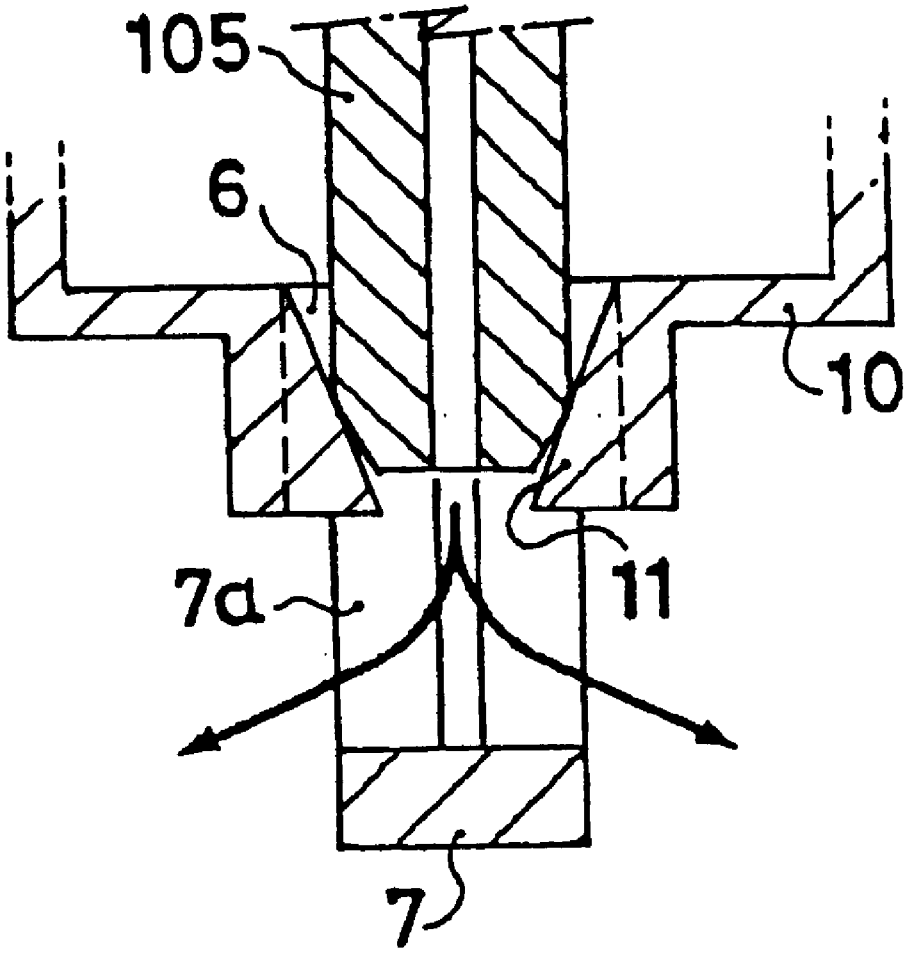
FIG. 4 is an enlarged sectional view of a main portion of the engaging through hole portion of the degassing tool of FIG. 1.
Figure 5A:
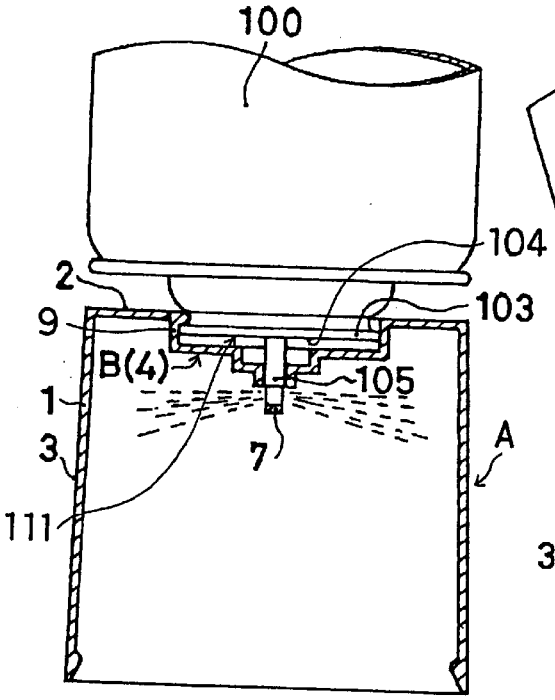
FIG. 5 is a sectional view for explaining a degassing method using the degassing tool of FIG. 1 and a method for indicating a degassed condition, wherein FIG. 5(*a*) illustrates a condition with the degassing tool being attached to an aerosol container, FIG. 5(*b*) a condition with the cutoff body being about to be separated from a degassing tool main body, and FIG. 5(*c*) a condition with only the cutoff body being attached to the aerosol container.
Figure 5B:
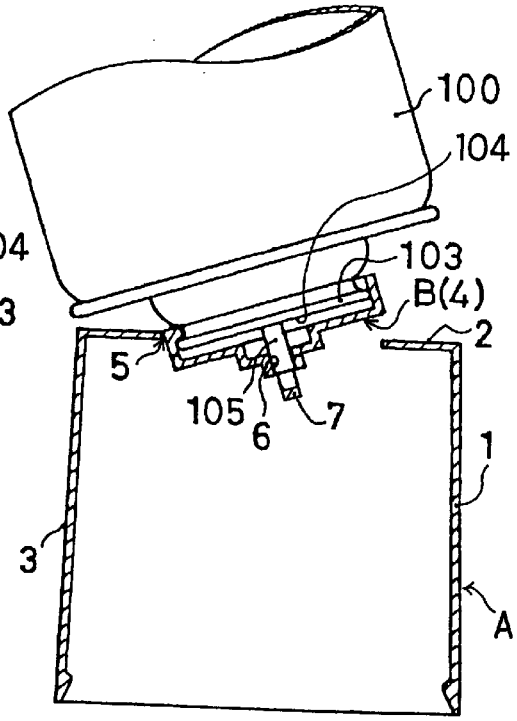
Figure 5C:
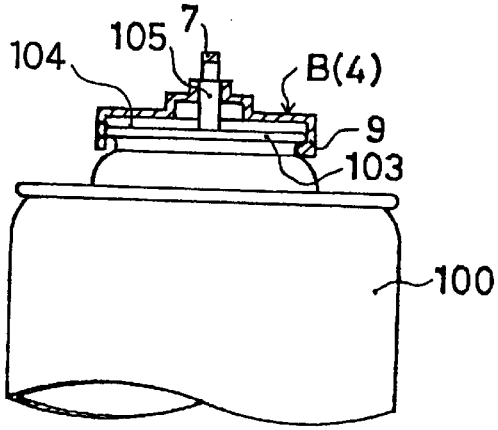

A degassing tool 1 as illustrated in FIGS. 1 to 6 is a degassing tool concurrently used as an aerosol cap with an indication denoting a degassed condition which might be utilized as a cap for aerosol container 100 in normal conditions as illustrated in FIG. 2 and further as a degassing tool by changing its direction upside down with respect to the aerosol container 100 as illustrated in FIG. 5(*a*).

The aerosol container 100 is a container made of steel including a roll-tight portion 101 being formed at an upper edge of a trunk of the container and an upper swell portion 102 being formed in a central portion on an upper surface of the container, while an upper peripheral edge of the swell portion 102 is formed as a bead portion 103. The container is further so arranged that a mounting cup 104 of an aerosol valve 111 is attached onto its surface through crimping and that a rod-like stem 105 is provided as to project from the central portion, wherein aerosol gas in the interior of the container is sprayed when the stem 105 is pressed inward.

The degassing tool 1 is integrally formed through injection molding of plastic, and as illustrated in FIGS. 1 and 2, a bottomed cylindrical shape is formed by a cap top surface 2 and a cap peripheral side surface 3. A fitting concave portion 4 capable of being fit to an upper portion of the aerosol container 100 is formed on the cap top surface 2 while a cutting preparatory line 5 is formed to surround this fitting concave portion 4, and a gas spraying hole 6 is formed in a center part of bottom surface portion 4*a* of the fitting concave portion 4. The arrangement further includes a direction changing portion 7 formed inside of the cap as to cross an axial direction of the gas spraying hole 6 and an indication denoting a degassed condition 8 inside of the cap of the bottom surface portion 4*a* of the fitting concave portion 4. At least a cutoff body (inward of the cutting preparatory line 5) B composed of the fitting concave portion 4, the gas spraying hole 6 and the indication denoting a degassed condition 8 is provided to be separable from a degassing tool main body A.

Each of the components will now be described in detail.

The bottomed cylindrical shape composed of the cap top surface 2 and the cap peripheral side surface 3 is formed to assume a sufficient height so as not to press the stem 105 when the cylindrical shape is attached to the upper portion of the aerosol container 100 as an aerosol cap, and an inside portion at an lower end of the cap peripheral side surface 3 is formed with protrusions 3*a* for engaging with the roll-tight portion 101.

The "fitting concave portion 4" is formed by depressing a central portion of the cap top surface 2 inward of the cap to assume a concave having a diameter and a depth with which at least the bead portion 103 and the aerosol valve 111 of the container 100 might be fitted therein, by forming engaging portions 9 on a concavely depressed inner peripheral side surface 4*b* at suitable intervals, by forming a double-stepped differently leveled concave portion 10 in the central portion of the bottom surface 4*a* for enabling the stem 105 to be easily inserted into the gas spraying hole 6, and by forming the gas spraying hole 6 as to pierce through the central portion of the differently leveled concave portion 10.

Here, each "engaging portion 9" is so arranged that a rectangular notched portion 9*a* is formed at the inner peripheral side surface 4*b* with its bottom side portion being remained uncut, that a vertical projecting piece 9*c* is formed as to erect from the bottom surface 4*a* within this notched portion 9*a* with a slight spacing maintained therefrom. The projecting piece 9*c* including an engaging projection 9*b* formed inside of an upper end portion thereof is elastically deformable in horizontal directions (inward and outward directions) such that engagement with the bead portion 103 of the container 100 might be achieved though the size of the bead portion is by somewhat varied.

The "gas spraying hole 6" is arranged such that the stem 105 might be inserted therein while a tip end portion of the stem 105 can be engaged at an intermediate portion of the hole. More concretely, the hole is formed to be a through hole communicating between the interior and exterior of the cap with a diameter sufficient to insert the stem 105 therein, and a plurality of engaging ribs 11 are formed at the inner peripheral surface of the hole as to extend in a coaxial direction of the hole. The engaging rib 11 is a sloped projecting line gradually projecting towards the interior of the hole (towards the central axis) in approaching the tip end direction of the hole (inside direction of the cap) such that the tip end portion of the stem 105 might be engaged with the engaging rib 11. However, the gas spraying hole of the present invention might be arbitrarily formed as long as the tip end portion of the stem 105 is inserted and engaged within the hole, some alternative arrangements being one in which the hole itself is formed to assume a convergent shape or in which a differently leveled portion is formed at an intermediate portion of the hole for engaging the tip end portion of the stem at this differently leveled portion.

The "direction changing portion 7" is formed in a bridging manner at an inside of the cap as to cross the axial direction of the gas spraying hole 6 while both lateral sides are left open to form gas spraying outlets 7*a*. Discharged gas is not linearly discharged but is hit against the direction changing portion 7 such that a great part of the gas is changed in direction, sprayed out from the gas spraying outlets 7*a,* and discharged to the inner surface of the cap peripheral side surface 3.

The "cutting preparatory line 5" is formed as a perforation within the top surface 2 of the cap along an upper edge of the fitting concave portion 4 to surround an immediate outer portion of the edge. While the illustrated embodiment utilizes such perforation, that is, an intermittent split line, the present invention is not limited to this arrangement so long as it is an easily separable arrangement, and might be arbitrarily formed by, for instance, providing a thin portion or providing an attachable/detachable fitting arrangement.

It should be noted that in case the cutting preparatory line 5 comprises a perforation, an intermittent portion thereof could be a film-like thin portion which is not completely cut. In this manner, it is not only enabled to provide an easily separable arrangement along the perforation but it is also possible to prevent leakage of gas or fluid from the cutting preparatory line 5. Consequently, gas or other contents in the cap interior will not be sprayed through the cutting preparatory line 5 and it is also possible to accumulate discharged fluid or the like within the cap by turning the degassing tool 1 upside down.

In the illustrated embodiment, the "indication denoting a degassed condition 8" is arranged by printing the word "degassed" at the inner surface of the cap at the bottom surface portion 4*a* of the fitting concave portion 4 as to surround the gas spraying hole 6. However, it is also possible to employ another indication means for informing this fact, for instance, simply printing the word "finished" or "emptied" or the like or printing, marking or shaping a specified form or a design other than letters.

The degassing tool 1 of the above-arrangement might be used as an aerosol cap as illustrated in FIG. 2 by engaging the projecting portions 3*a* with the roll-tight portion 101 of the container.

If one should wish to perform degassing, the degassing tool 1 is turned down as illustrated in FIG. 5(*a*), the bead portion 103 and the aerosol valve 111 of the container are inserted into the fitting concave portion 4 of the degassing tool 1, the stem 105 is inserted into the gas spraying hole 6, and the outer peripheral surface of the mounting cup 104 is engaged with the engaging portions 9. In this condition, the stem 105 is engaged by the engaging rib 11 within the gas spraying hole 6 to be in a pressed condition as illustrated in FIG. 4 so that aerosol gas might be sprayed. In this manner, degassing can be performed even in a hand-free condition by attaching the degassing tool 1 to the aerosol container 100.

Figure 6:
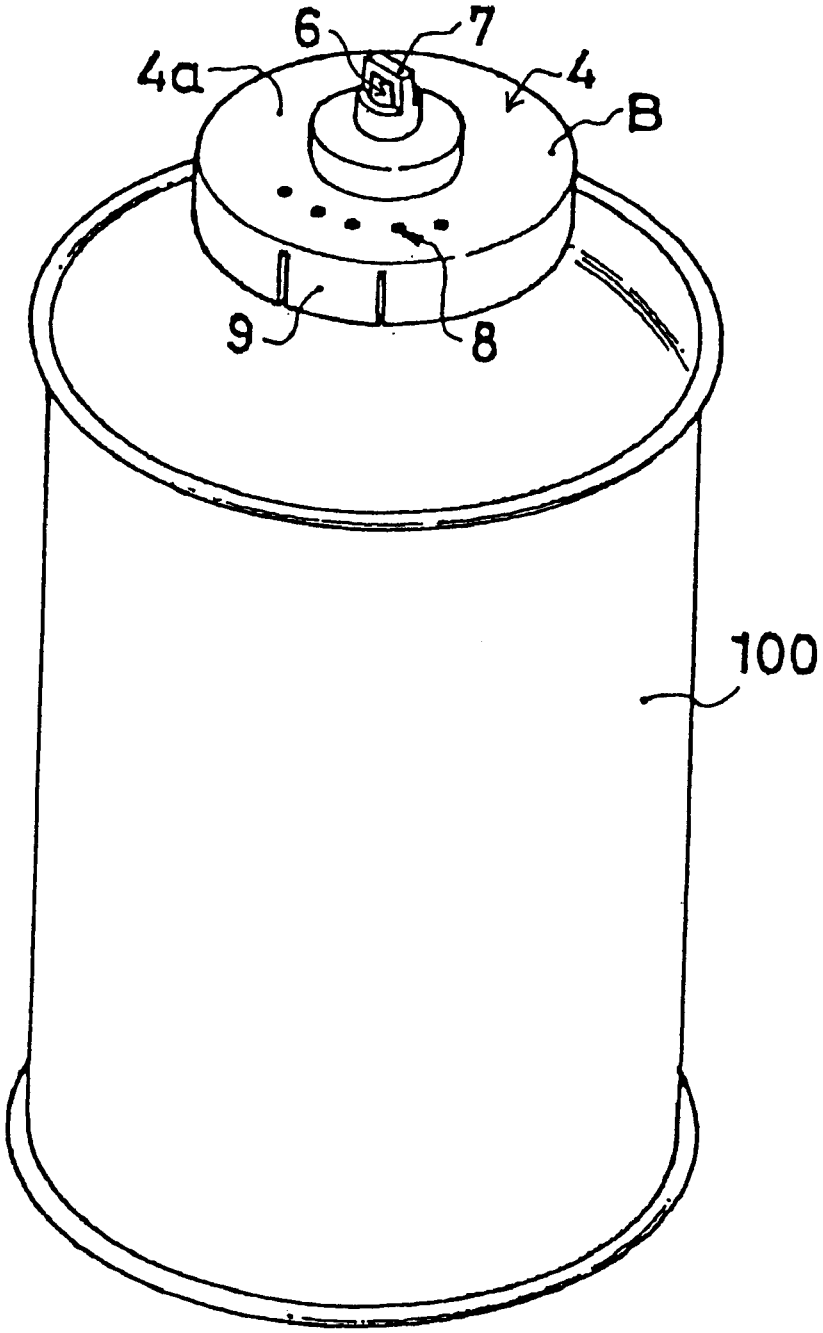
FIG. 6 is a perspective view showing one example of an aerosol container in a condition with the cutoff body of the degassing tool of FIG. 1 being attached to the aerosol container, that is, in a condition ready for discard.

In case of discarding the aerosol container 100, after completing degassing in the above-described manner, the inward portion (that is, the cutoff body B) is separated from the degassing tool main body A along the cutting preparatory line 5 through reversing or the like with the outer peripheral surface of the mountain cup 104 being remained fitted at the fitting concave portion 4 as illustrated in FIG. 5(*b*) to assume a condition in which only the cutoff body (portion inward of the cutting preparatory line 5) B is attached to the aerosol container 100 as illustrated in FIG. 5(*c*) and FIG. 6. At this time, that is, in a condition with the cutoff body B being attached at the aerosol container 100 as illustrated in FIG. 6, the cutoff body B includes the fitting concave portion 4, the gas spraying hole 6 and the indication denoting a degassed condition 8 such that the indication denoting a degassed condition 8 is positioned at the outer surface side, thereby this indication can be apparently be recognized by everybody. The fitting condition between the fitting concave portion 4 and the outer peripheral surface of the mounting cup 104 is maintained and the stem 105 is maintained in a pressed condition, that is, in which the interior and exterior of the container are communicated.

According to the degassing tool of the above-described arrangement, it is thus possible to use the tool as a cap of a container, to perform degassing by fitting and attaching the same to the upper portion of the aerosol container, and moreover, to indicate a degassed condition such that everybody can apparently recognize this fact by simply maintaining the fitted and attached condition of at least the cutoff body B to the aerosol container upon completion of degassing. It is also possible to discard the aerosol container with the stem being maintained in a pressed condition. While a degassed container will pose no danger of explosion and is tolerably safe, it will definitely be even safer to discard the container with the stem 105 in a pressed condition with the interior and exterior of the container being communicated. Moreover, since everybody can recognize with one's own eyes that the stem 105 is maintained in a pressed condition and that the interior and exterior of the container are communicated, persons engaged in the cleaning or garbage-collecting business might collect such aerosol containers in an even more carefree manner.

By discarding the container with only the cutoff body B being attached to the aerosol container upon separating the cutoff body B from the degassing tool main body A, it is possible to make the indicating body with the indication for denoting a degassed condition even smaller and more compact when compared to a case in which the container is discarded with the entire degassing tool being attached to the aerosol container, whereby the container can be quite conveniently collected and stored without being bulky.

In the degassing tool 1, it is possible to manufacture only the cutoff body B of a material which is of the same group as that of the aerosol container 100. More concretely, the cutoff body B might be formed of metallic material, preferably of light metallic material, and most preferably of steel material. For instance, the cutoff body B might be preliminarily formed of steel and this cutoff body B made of steel is then fitted into the plastic injection mold whereupon plastic is injected to integrally form the degassing tool main body A of plastic and the cutoff body B of steel, and thereafter, the cutting preparatory line 5 is formed on the side of the degassing tool main body A of plastic along the cutoff body B of steel. In this case, it may happen that some plastic will adhere to a periphery of the cutoff body B upon separation of the cutoff body B of steel.

Figure 7A:
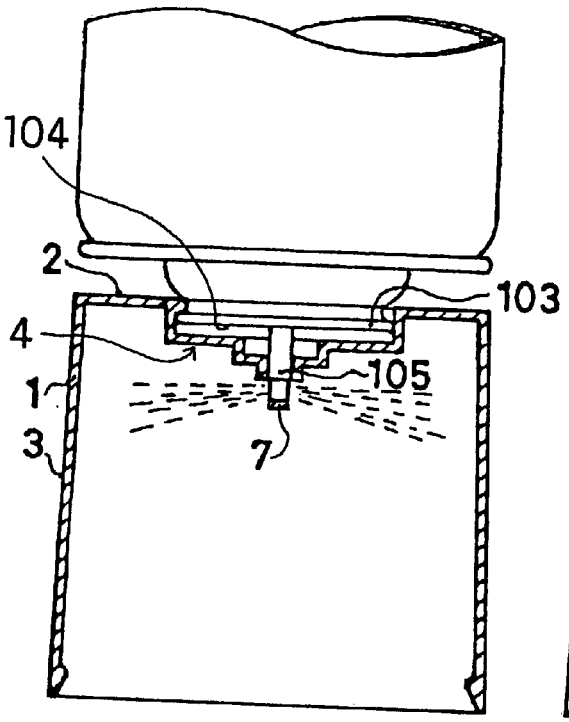
FIGS. 7(*a*), 7(*b*) and 7(*c*) are sectional views showing a degassing method which is somewhat different from the method of FIGS. 5(*a*), 5(*b*) and 5(*c*)
Figure 7B:
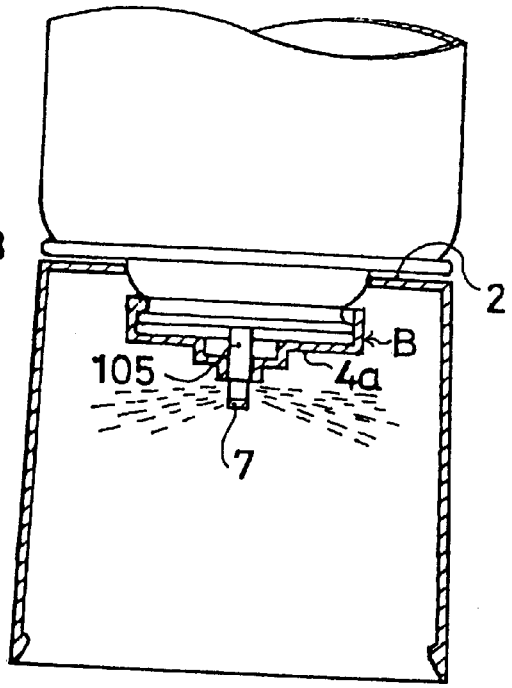
Figure 7C:
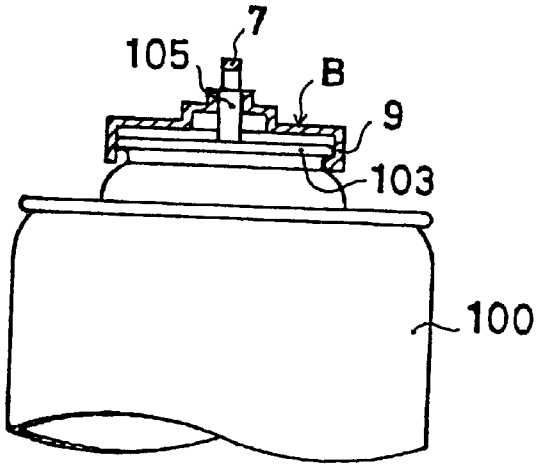

Alternative to separating the cutoff body B upon completion of degassing as described above, it is also possible to separate the cutoff body B from the degassing tool main body A by pressing the aerosol container 100 inward of the cap during or after fitting the outer peripheral surface of the mounting cup 104 at the fitting concave portion 4, that is, during degassing, for spraying gas in the interior of the cap, as illustrated in FIGS. 7(*a*), and 7(*b*).

However, it might happen that the aerosol container 100 comes off the degassing tool main body A while spraying gas in case the cutting preparatory line 5 is formed to assume a circumferential shape as illustrated in FIG. 1 and the cutoff boy B is separated during degassing by pushing the same inward of the cap.

Figure 8:
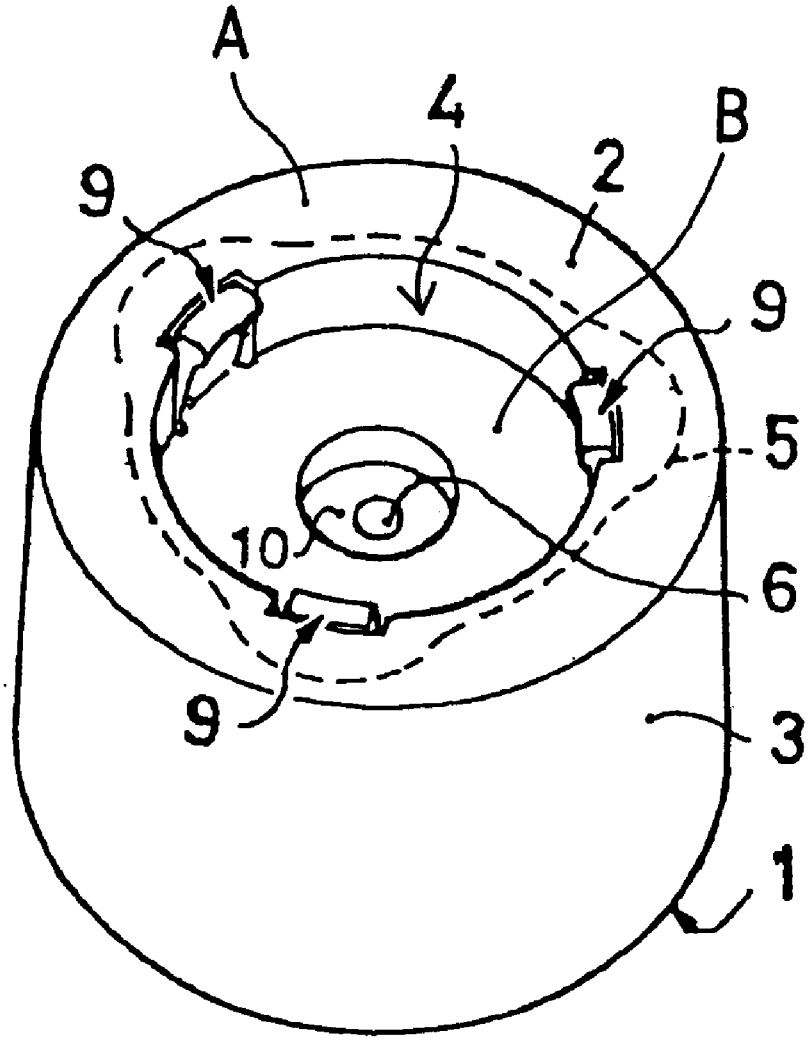
FIG. 8 is a perspective view showing a modified example of the degassing tool of FIG. 1 (a modified example of the cutting preparatory line)

To cope with this problem, the cutting preparatory line 5 is formed to assume a non-circular shape such as a triangular shape as illustrated in FIG. 8, a square shape, a waved shape or an elliptic shape. More concretely, upon cutting along the cutting preparatory line 5, the cutoff body B is pushed inward of the degassing tool main body A and is rotated for a suitable angle thereafter, the cutting edge of the degassing tool main body A will engage with the cutting edge of the cutoff body B to assume a shape with which the cutoff body B will not come off the degassing tool main body A.

Figure 9A:
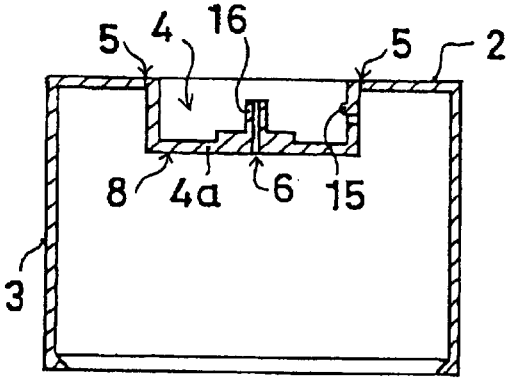
FIGS. 9(*a*) and 9(*b*) are views showing an example of a degassing tool of an arrangement different from that of the degassing tool of FIG. 1, wherein FIG. 9(*a*)is a sectional view thereof and FIG. 9(*b*) a view showing a condition of use.
Figure 9B:
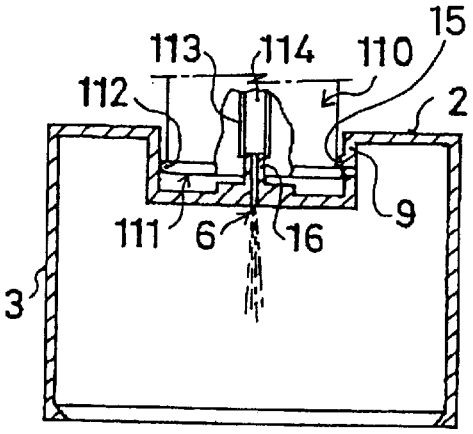
Figure 10:
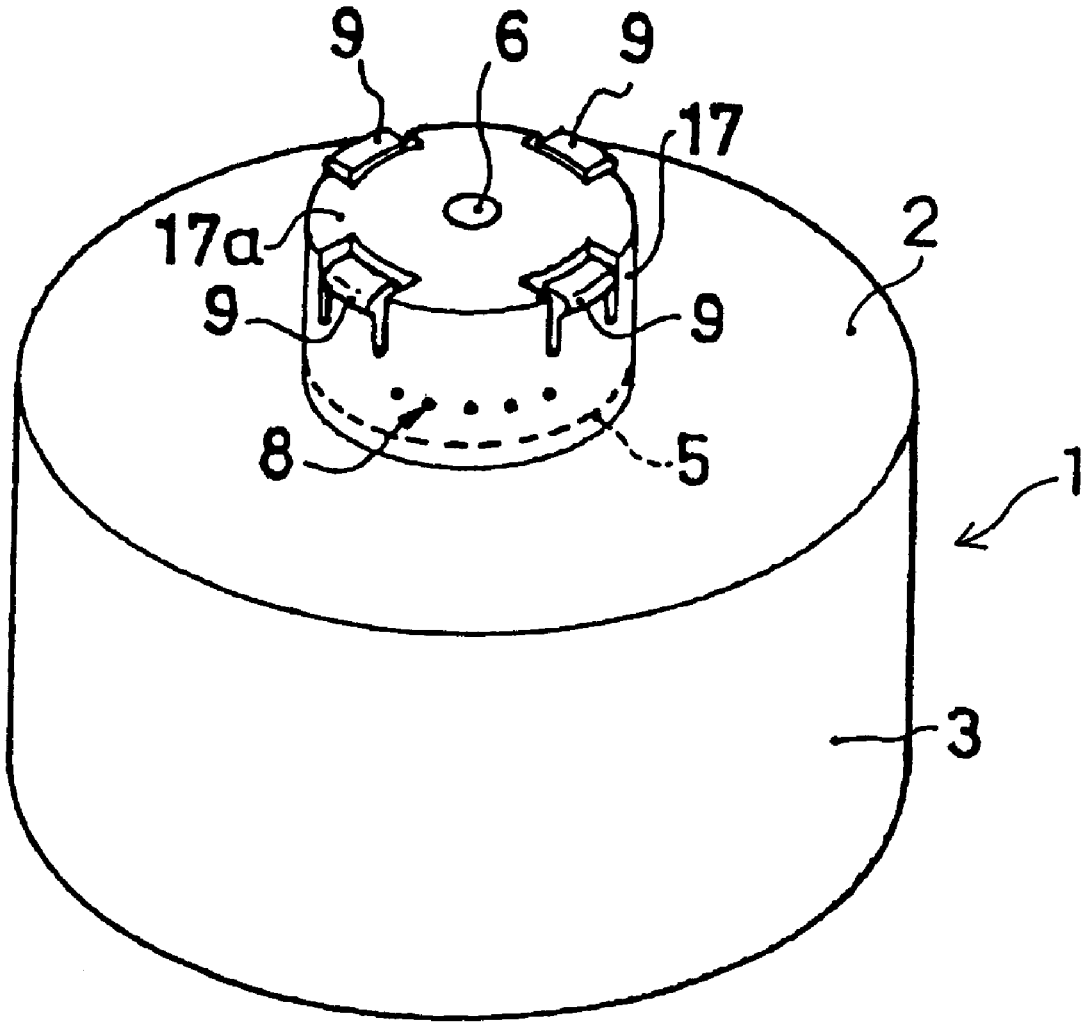
FIG. 10 is a perspective view showing another example of a degassing tool of an arrangement different from that of the degassing tool of FIG. 1.

It should be noted that the shape of the degassing tool is not limited to the above-described arrangement, and it is possible to employ any shape as long as the degassing tool is capable of maintaining the aerosol container in a spraying condition when being attached to the aerosol container. It is, for instance, possible to employ an arrangement as illustrated in FIG. 9 (*a*), wherein an engaging portion 15 (the direction of the engaging claw corresponds to that of FIG. 1 turned upside down) is provided at the upper edge portion of the fitting concave portion 4 of the degassing tool 1, and an inserting portion 16 projecting in an outside direction of the cap is formed at the central portion of the bottom surface portion 4*a* of the fitting concave portion 4, the interior of this inserting portion 16 being the gas spraying hole 6. Then, as illustrated in FIG. 9(*b*), the engaging portion 15 is engaged with a mounting cup 112 of an aerosol container 110 with its stem 114 being not projecting to aerosol valve 111 so that the inserting portion 16 is inserted into a path 113 within the stem of the aerosol valve 111 to make the stem 114 in the interior thereof assume a pressed condition for spraying gas. In another arrangement as illustrated in FIG. 10, a projecting portion 17 which can be fitted into a concave depressed portion formed in a mounting cup of an aerosol valve is provided at a top surface 2 of the cap of the degassing tool 1, engaging portions 9 are provided at suitable intervals along an upper edge portion of the projecting portion 17, and the gas spraying hole 6 is provided in a central portion of an upper surface 17*a* of the projecting portion 17.

Figure 11A:
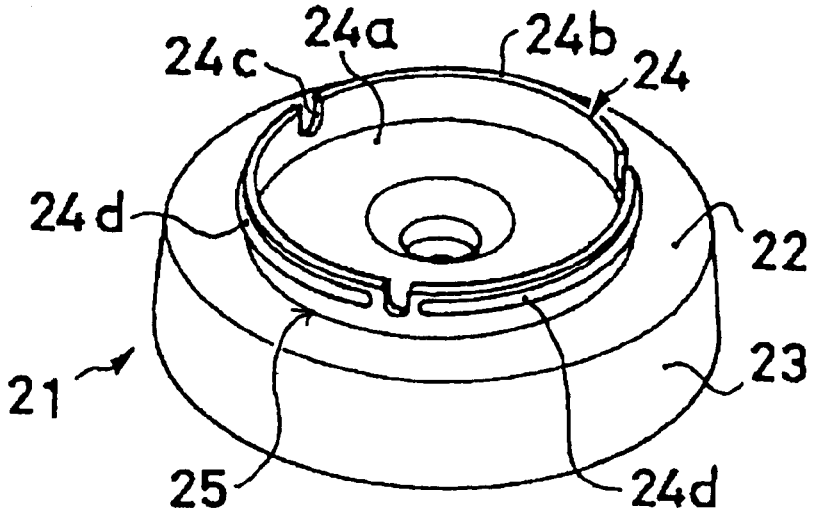
FIGS. 11(*a*) and 11(*b*) are views showing still another example of a degassing tool of an arrangement different from that of the degassing tool of FIG. 1, wherein FIG. 11(*a*) is a respective view of its upper surface side and (b) a perspective view of its lower surface side.
Figure 11B:
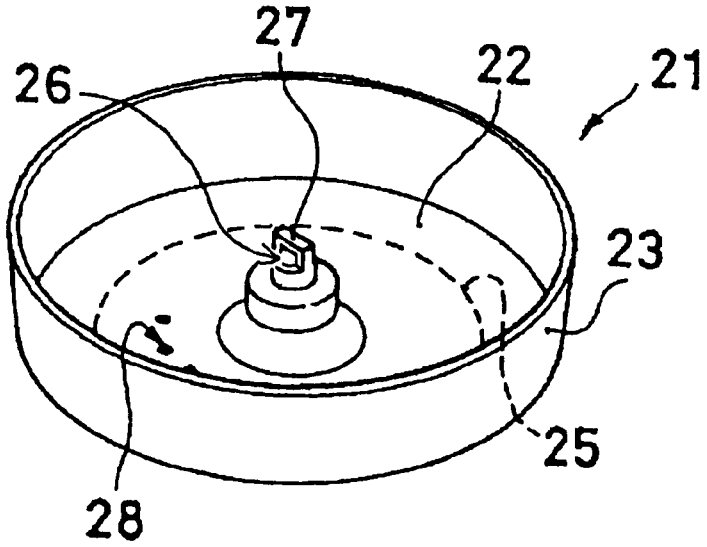

It is of course possible to also employ an arrangement of a degassing tool having no function as an aerosol cap as illustrated in FIGS. 11*a* and 11*b*. More concretely, in a degassing tool 21 as illustrated in FIGS. 11 (*a*) 11(*b*), a bottomed cylindrical shape is formed by a top surface 22 and peripheral side surface 23 in which a fitting concave portion 24 capable of being fit with a mounting cup is formed in the top surface 22 while a cutting preparatory line 25 is formed to surround this fitting concave portion 24, and a gas spraying hole 26 is formed in a center part of bottom surface portion 24*a* of the fitting concave portion 24. The arrangement further includes a direction changing portion 27 which is formed inside of the cylindrical body as to cross an axial direction of the gas spraying hole 26, and an indication denoting a degassed condition 28 is provided inside of the cap of the bottom surface portion 24*a* of the fitting concave portion 24. The fitting concave portion 24 is so arranged that an annular upright wall portion 24*b* is formed in the fitting concave portion 24 and is provided with notched portions 24*c* at suitable intervals to be elastically deformable in inward and outward directions, and that a projecting linear portion 24*d* is provided in a peripheral direction at the outer peripheral surface of the annular upright wall portion 24*b*.

The location for providing the indication denoting a degassed condition 28 is selected to be a spot which comprises the outer surface, that is, a surface which is visible to one's eyes when the degassing tool is attached to an aerosol container, and while it is generally preferable that this indication is made on a surface which forms the upper surface when being attached to the container as it is the case with the above-described degassing tool 1, a suitable location shall be selected depending on the shape of the tool or type of the container. For instance, the indication might be attached to an inside surface of the cap at the peripheral side surface of the fitting concave portion 4, or, as illustrated in FIG. 10, at the peripheral side surface of the projecting portion 17.

The position for providing the cutting preparatory line 5 might be suitably selected depending on the shape of the degassing tool or the container as well as on the type of the container, provided that this position is a position surrounding a portion including the indication for denoting a degassed condition, and might be formed, for instance, on the top surface 2 of the cap, bottom surface 4*a* or peripheral side surface of the fitting concave portion 4, cap peripheral side surface 3 of the cap, or peripheral side surface of the projecting portion 17.

Embodiment 2

Figure 12A:
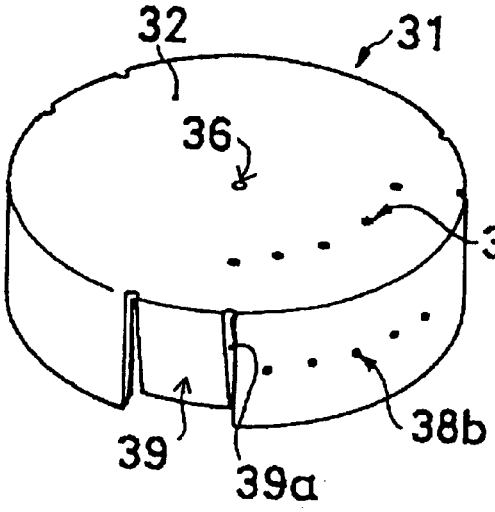
FIGS. 12(*a*), 12(*b*) and 12(*c*) are views showing an example of a degassing tool according to another embodiment as that of the degassing tool of FIG. 1, wherein FIG. 12(*a*) is a perspective view of its upper surface side, FIG. 12(*b*) sectional view thereof, and FIG. 12(*c*) a perspective view of its lower surface side.
Figure 12B:
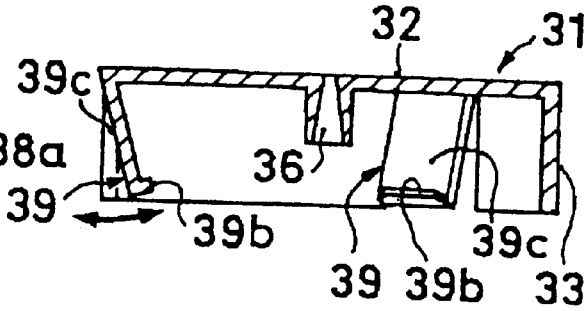
Figure 12C:
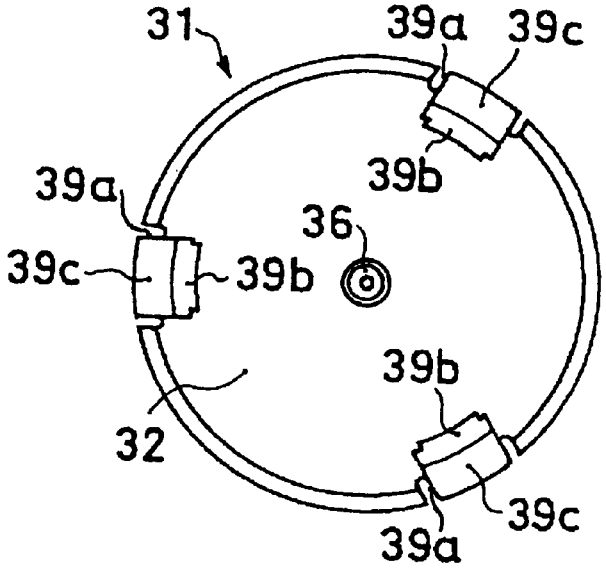
Figure 13:
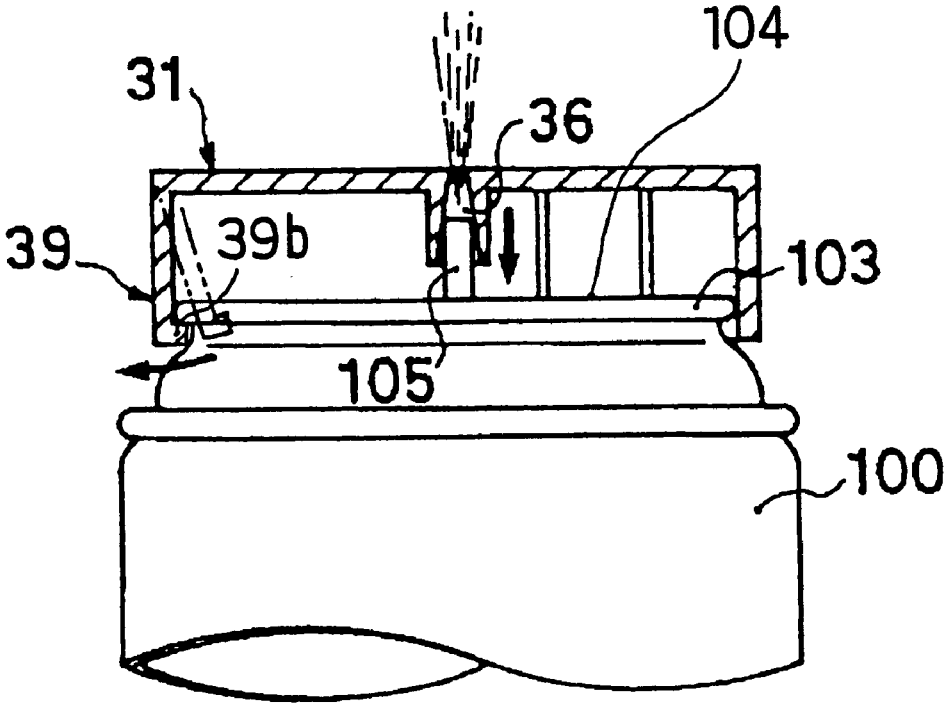
FIG. 13 is a sectional view showing a condition of use of the degassing tool of FIGS. 12(*a*)–(*c*)

A degassing tool 31 as illustrated in FIGS. 12(*a*)–(*c*) and FIG. 13 is not of an arrangement as that of the above-described degassing tool 1 in which a part of the degassing tool (cutoff body B) with an indication for denoting a degassed condition is separated during degassing or upon completion of degassing but is a degassing tool with an indication for denoting a degassed condition wherein a pressed condition of the stem is achieved and a degassed condition is indicated by attaching the entire degassing tool to an aerosol container and maintaining this attached condition.

More concretely, the degassing tool 31 is integrally formed by injection molding of plastic, and a bottomed flat cylindrical shape having a diameter substantially identical with the outer diameter of the mounting cup 104 is formed by a top surface 32 and a peripheral side surface 33. The arrangement further includes a gas spraying hole 36 which is formed in a central portion within the top surface 32 with indications denoting a degassed condition 38*a* being formed to surround the gas spraying hole 36, while the peripheral side surface 33 is provided with engaging portions 39, 39 at suitable intervals with indications denoting a degassed condition 38*b* being formed between each of the adjoining engaging portions 39, 39.

The gas spraying hole 36 is arranged such that the stem 105 can be inserted therein from inside of the bottomed flat cylindrical body wherein the hole itself is arranged as to assume a shape which is convergent in extending from inside to outside of the bottomed flat cylindrical body such that the tip end portion of the stem 105 might be engaged at an intermediate portion of the hole.

Each engaging portion 39 is arranged, as illustrated in FIGS. 12 (*a*) to (*c*), in that a rectangular notched portion 39*a* is formed at the peripheral side surface 33 with an upper side portion being remained uncut, and a vertical projecting piece 39*c* is formed as to suspend from the top surface 32 within these notched portions 39*a* with a slight spacing maintained therebetween, the piece 39*c* including an engaging projection 39*b* formed inside of the lower end portion and being elastically deformable in inward and outward directions.

The indications for denoting a degassed condition 38*a*, 38*b* might be arranged similarly to the indication for denoting a degassed condition 8.

As illustrated in FIG. 13, in case of the degassing tool 31 of the above-described arrangement, the stem 105 is inserted into the gas spraying hole 36 from inside of the bottomed flat cylindrical body and an outer periphery of the mounting cup 104 is engaged with the engaging projections 39*b* of the engaging portions 39, whereby the tip end portion of the stem 105 is engaged within the gas spraying hole 36 to assume a pressed condition and thus a gas spraying condition.

In case the aerosol container 100 is discarded after performing degassing of the aerosol container 100 in this manner with the degassing tool 31 being maintained in the engaged and attached condition, it is possible to inform everybody that the aerosol container 100 has been degassed by means of the indications denoting a degassed condition 38*a*, 38*b*. Moreover, the aerosol container 100 is even safer with the interior and exterior of the container being maintained in a communicated condition, and everybody including persons engaged in the cleaning and garbage-collecting business can confirm this fact with one's own eyes, that is, that the stem 105 is maintained in a pressed condition and that the interior and exterior of the container is maintained in the communicated condition.

It should be noted that the degassing tool 31 might be of metallic material, preferably of light metallic material, most preferably of steel material. In this manner, it is possible to cope with discrete collection of items of garbage for segregation in to different groups even if the aerosol container 100 is discarded with the degassing tool 31 being maintained in the engaged and attached condition.

Embodiment 3

Figure 14:
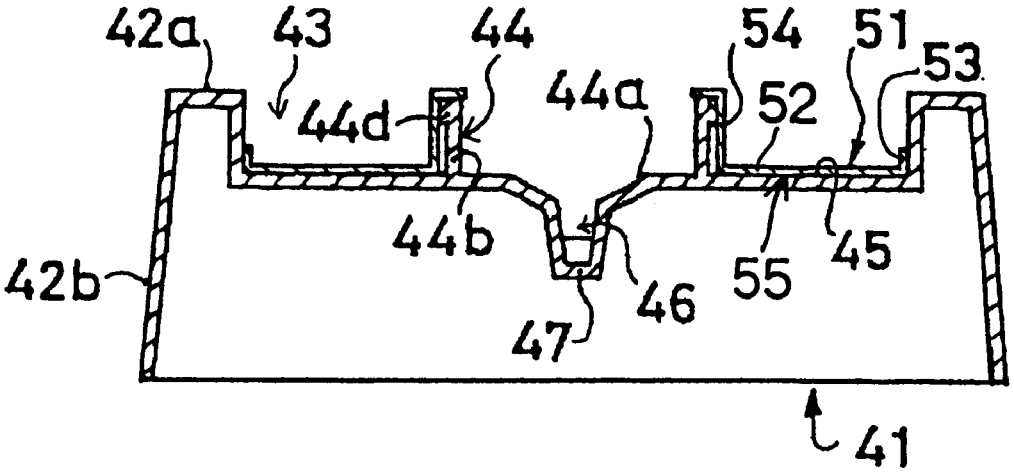
FIG. 14 is a sectional view showing one example of a degassing tool and an arrangement for indicating a degassed condition according to another embodiment as that of the degassing tool of FIG. 1.
Figure 15:
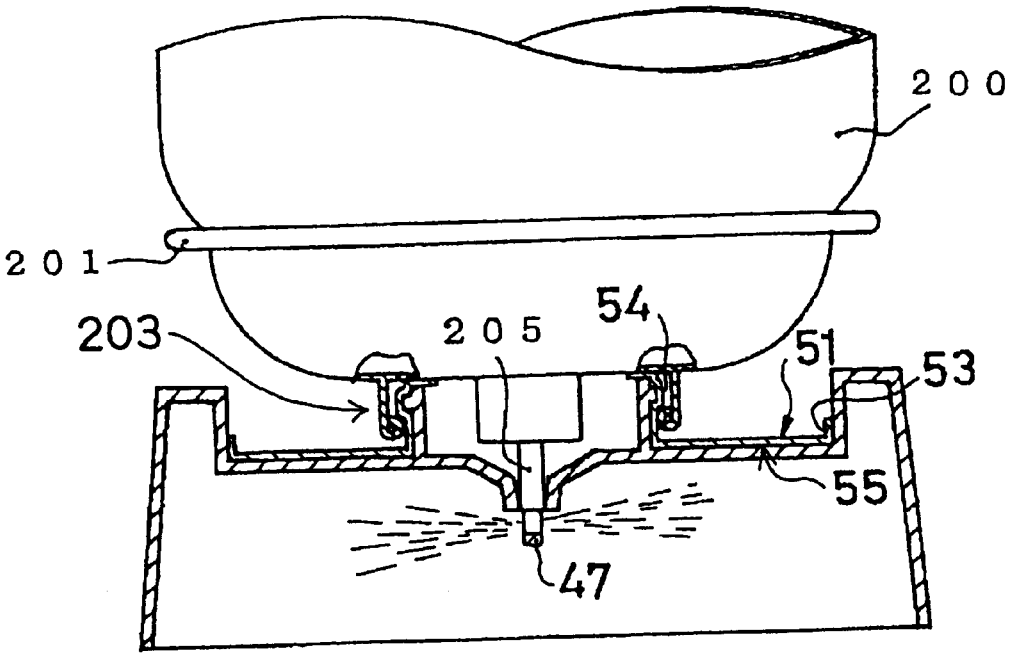
FIG. 15 is a sectional view showing a condition for performing degassing by using the degassing tool of FIG. 14.

A degassing tool 41 as illustrated in FIG. 14 is a degassing tool including no indication denoting a degassed condition and is so arranged that an indicating body for denoting a degassed condition 51 with an indication for denoting a degassed condition 55 is attachable thereto.

The degassing tool 41 is so arranged that a bottomed cylindrical shape is formed by a top surface 42*a* and a peripheral side surface 42*b*, wherein a concave depressed portion 43 which is depressed in a concave shape inward of the bottomed cylindrical body is formed in the top surface 42*a* with a fitting concave portion 44 being erected within the concave depressed portion 43 and with an annular groove portion 45 being formed outside of the fitting concave portion 44 in the concave depressed portion 43. A gas spraying hole 46 is formed at a central part of bottom surface portion 44*a* of the fitting concave portion 44 and a direction changing portion 47 is formed to cross an axial direction of the gas spraying hole 46 with respect to an inside portion of the cylindrical body.

The fitting concave portion 44, the spraying hole 46, and the direction changing portion 47 are similarly formed as the fitting concave portion 24, the spraying hole 26 and the direction changing portion 27 of the above-described degassing tool 21, and in case a stem 205 of an aerosol container 200 as explained in Embodiment 4 below is inserted into the spraying hole 46 and a mounting cup 203 is fitted and attached to the fitting concave portion 44 from outside, a tip end portion of the stem 205 will be engaged within the spraying hole 46 to assume a pressed condition.

On the other hand, the indicating body for denoting a degassed condition 51 is formed of a sheet-like body having a suitable thickness with flexible or deformable characteristics. An annular plate portion 52 is formed which might be inserted into an annular groove portion 45 with an outside edge of the annular plate portion 52 being somewhat erected in width to form an engaging edge portion 53, while an inside edge of the annular plate portion 52 being erected to form an engaging wall portion 54 which is upright along an outer side surface of annular upright wall portion 44*b* of the concave depressed portion 44 and which covers an upper end portion of the annular upright wall portion 44*b*. An indication for denoting a degassed condition 55 is further formed at outer side surface 52*a* of the annular plate portion 52 (a surface side opposite to the side at which the engaging wall portion 54 is erected).

It should be noted that the indicating body for denoting a degassed condition 51 might be formed of any material as long as it exhibits flexible or deformable characteristics as explained above, and might be formed of plastic, of paper such as corrugated paper, cardboard or synthetic paper, or of metal. The indicating body for denoting a degassed condition 51 might also be formed of a material of the same group as that of the aerosol container 200, that is, of metallic material, preferably light metallic material, and most preferably steel material whereby it is possible to cope with discrete collection so as to segregate garbage even if the aerosol container 200 is discarded while the degassing tool 51 is maintained in the engaged and attached condition.

Figure 16:
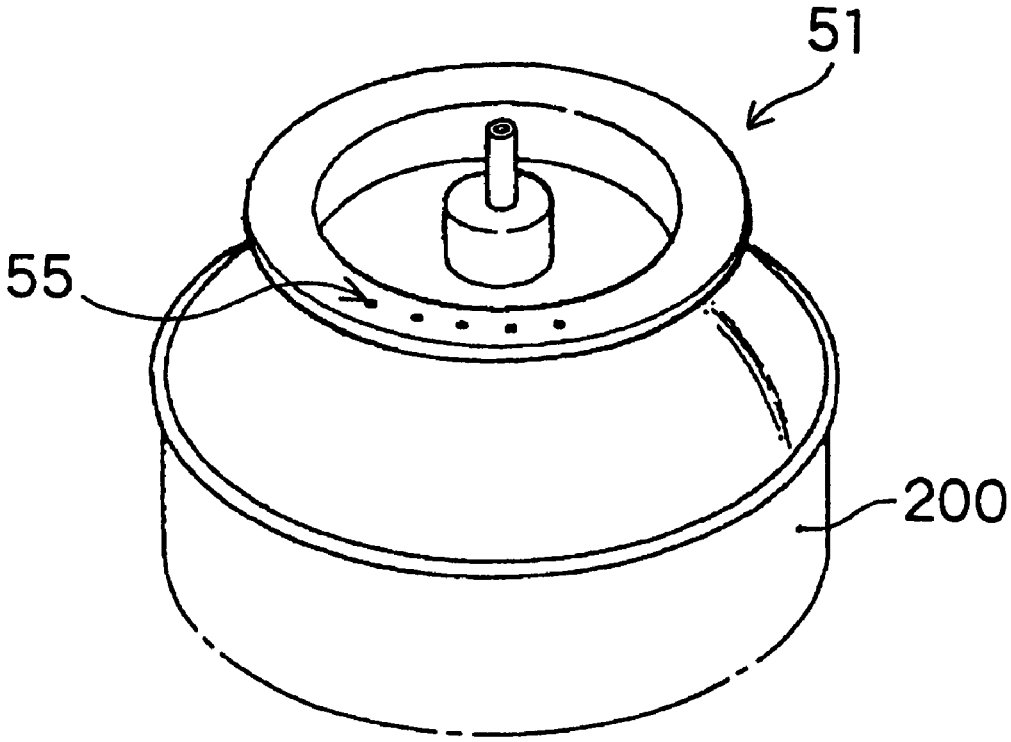
FIG. 16 is a perspective view showing an arrangement for indicating a degassed condition in which an indicating body for indicating a degassed condition of FIG. 14 is attached to the aerosol container, that is, an example of an aerosol container in a condition ready for being discarded.

At the time of performing degassing, the indicating body for denoting a degassed condition 51 is preliminarily attached into the annular groove portion 45 of the degassing tool 41, preferable in such a manner that the indicating body is fit in a detachable manner though it does not come off easily. In this condition, the stem 205 of the aerosol container 200 is inserted into the spraying hole 46 while the mounting cup 203 is fitted and attached to the annular upright wall portion 44*b* of the fitting concave portion 44 from outside such that the stem 205 assumes a pressed condition for performing degassing. At this time, the engaging wall portion 54 of the indicating body for denoting a degassed condition 51 is pinched between the mounting cup 203 and the annular upright wall portion 44*b* such that the engaging wall portion 54 is deformed along concaves and convexes of a projecting linear portion 44*d* of the annular upright wall portion 44*b* and the engaging wall portion 54 itself is engaged and attached to the projecting linear portion 44*d* of the annular upright wall portion 44*b*. In this manner, when the degassing tool 41 is released from the engaged and attached condition with the aerosol container 200, it is possible to leave only the indicating body for denoting a degassed condition 51 in the engaged and attached condition with the aerosol container 200 as illustrated in FIG. 16, and it is possible to indicate that the container has been degassed by means of the indication for denoting a degassed condition 55 of the indicating body for denoting a degassed condition 51.

According to such arrangement of indicating a degassed condition and method for indicating a degassed condition, it is possible to repeatedly perform degassing and indication for denoting a degassed condition by preparing a plurality of indicating bodies for denoting a degassed condition 51.

It is also possible to provide the indicating body for denoting a degassed condition 51 with an engaging portion with which the stem might be maintained in the pressed condition at the time of being attached to the aerosol container as well as a gas spraying hole.

Embodiment 4

Figure 17:
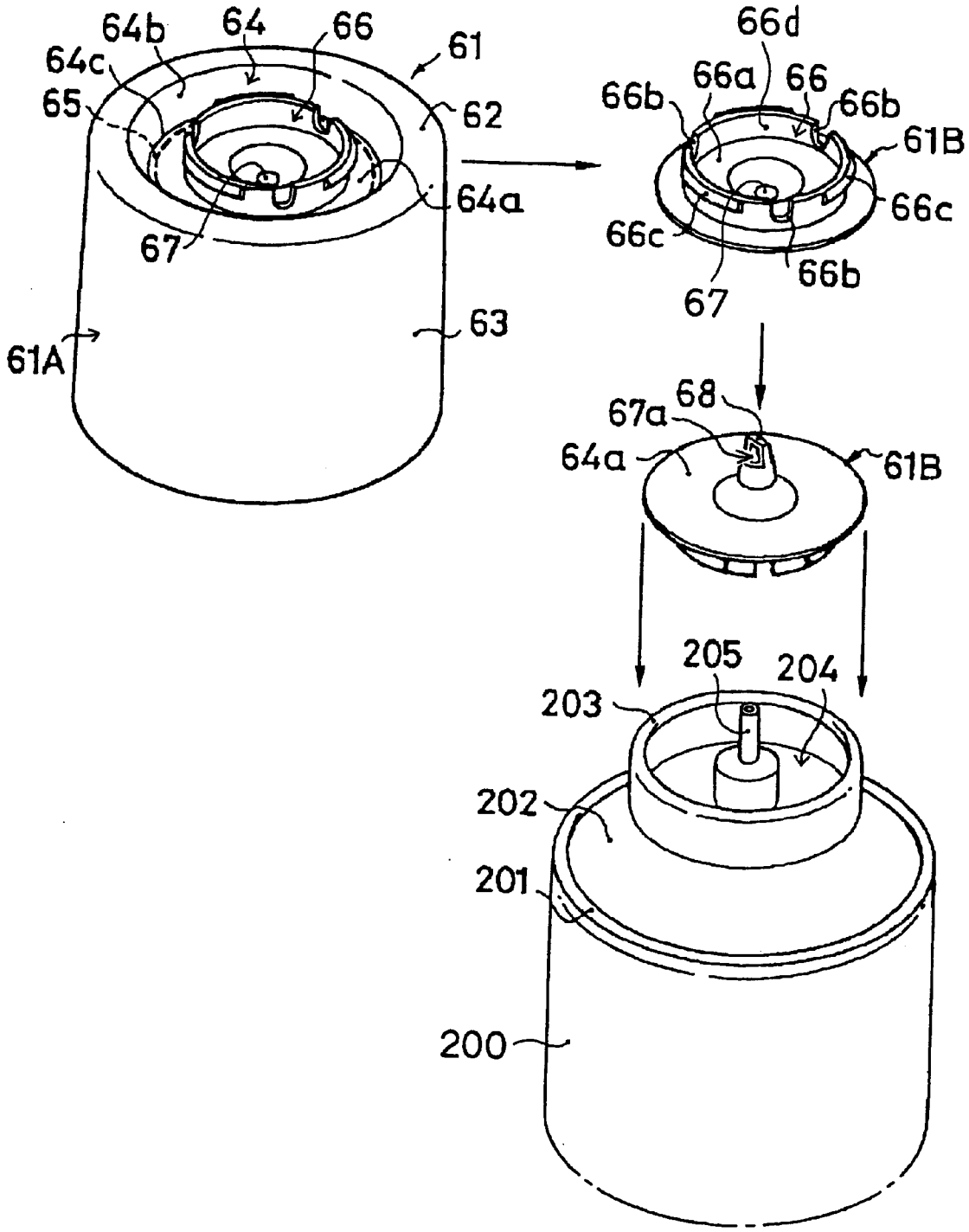
FIG. 17 is a perspective view showing a degassing tool according to a modified example of the degassing tool of FIG. 1, a front surface side and a rear surface side of a part of the separated degassing tool, that is, the cutoff body, and a condition thereof being attached to the aerosol container.

A degassing tool 61 as illustrated in FIG. 17 is a modified example of the above-described degassing tool 1 which might be utilized as a cap for an aerosol container 200 in normal conditions and also as a degassing tool by turning the same upside down with respect to the aerosol container 200. When comparing the illustrated tool with the above-described degassing tool 1, the degassing tool 61 differs from the tool 1 in the arrangement of the fitting concave portion 4, the presence/absence of the indication for denoting a degassed condition 8 and the location for providing the cutting preparatory line 5.

The aerosol container 200 is so arranged that a roll-tight portion 201 is formed at an upper edge of a trunk portion of the container and that an upper swell portion 202 is formed to extend from the roll-tight portion 201, while a bead portion (not shown) is formed at an upper surface portion of the swell portion 202. A mounting cup 203 of an aerosol valve 204 is mounted as to cover an upper periphery of the bead portion and is attached thereto through crimping, and a rod-like stem 205 is provided at a central portion thereof such that aerosol gas in the interior of the container is sprayed when the stem 205 is pressed inward.

The degassing tool 61 is integrally formed through injection molding of plastic and is so arranged that a bottomed cylindrical shape is formed by a cap top surface 62 and a cap peripheral side surface 63, wherein a concave depressed portion 64 which is depressed in a concave shape inward of the bottomed cylindrical body is formed in the top surface 62, with a cutting preparatory line 65 being formed in a bottom surface 64*a* of the concave depressed portion 64 along a bottom edge of the concave depressed portion 64, that is, an erected edge of an inner peripheral wall surface 64*b* of the concave depressed portion 64. A fitting concave portion 66 is further provided to be upright in the concave depressed portion 64 with an annular groove portion being formed outside of the fitting concave portion 66 in the concave depressed portion 64, while a gas spraying hole 67 is formed at a central part of bottom surface portion 66*a* inside of the fitting concave portion 66. With this arrangement, by cutting along the cutting preparatory line 65, at least a cutoff body 61B composed of the fitting concave portion 66 and the gas spraying hole 67 can be separated from a degassing tool main body 61A. The gas spraying hole 67 is arranged to project to inside of the cap, and a direction changing portion 68 is provided at a tip end aperture of the gas spraying hole 67 as to cross the axial direction.

The fitting concave portion 66 is so arranged that an annular erected wall portion 66*d* is provided to be upright in the bottom surface 64*d* of the concave depressed portion 64 with notches 66*b* being formed at suitable portions of the annular erected wall portion 66*d* such that the erected wall portions between the notches 66*b*, 66*b* are elastically deformable in inward and outward directions. An engaging projecting linear portion 66*c* is provided in a peripheral direction along the outer peripheral surface of the annular erected wall portion 66*d*, and in case the annular erected wall portion 66*a* is pushed into an inner peripheral surface of the mounting cup 203 of the aerosol valve as illustrated in FIG. 8(*a*), the engaging projecting linear portion 66*c* is elastically engaged with the inner peripheral surface of the mounting cup 203 while the tip end portion of the stem 205 enters the gas spraying hole 67 and is engaged thereat such that the stem 205 assumes a pressed condition.

Figure 18A:
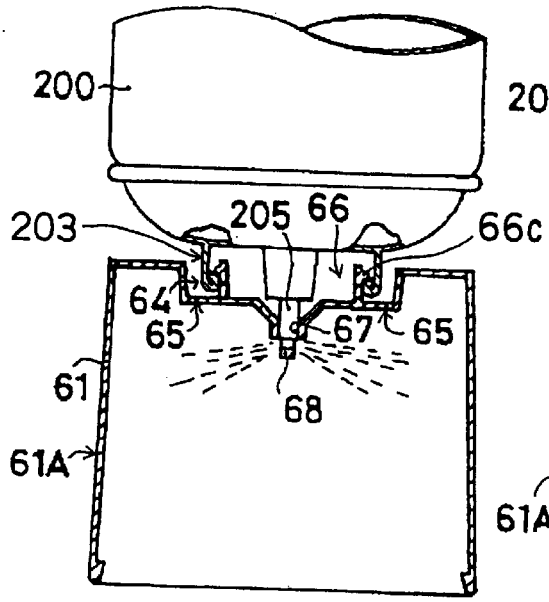
FIGS. 18(*a*), 18(*b*) and 18(*c*) are sectional views for explaining a degassing method by using the degassing tool of FIG. 17, wherein FIG. (a) illustrates a condition with the degassing tool being attached to an aerosol container, FIG. 18(*b*) a condition with the cutoff body being about to be separated from a main body of the degassing tool, and FIG. 18(*c*) a condition with only the cutoff body being attached to the aerosol container.
Figure 18B:
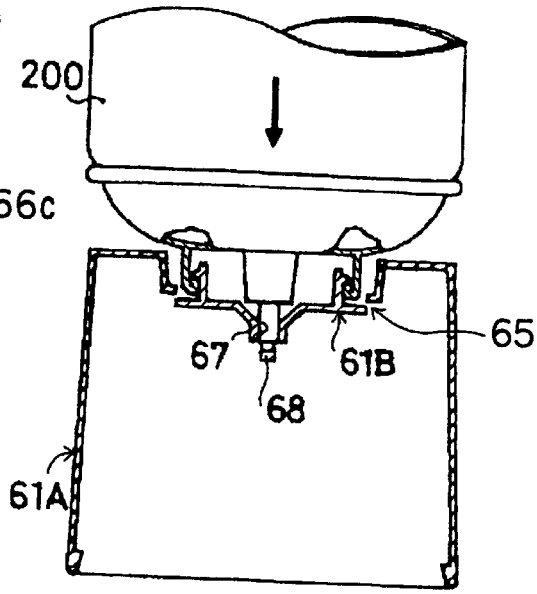
Figure 18C:
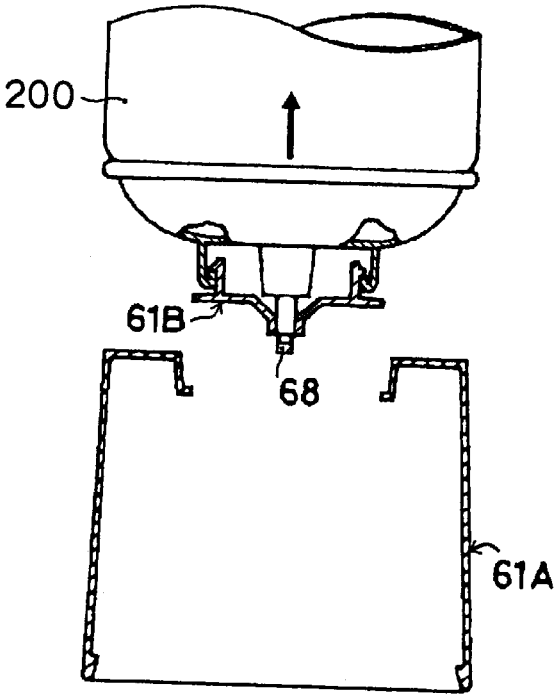

Similarly to the above-described degassing tool 1, the degassing tool 61 might be used as an aerosol cap, and if one should wish to perform degassing, the degassing tool 61 is turned down as illustrated in FIG. 18(*a*), a joining portion between a bead portion and the mounting cup 203 is inserted into the concave depressed portion 64 by turning the aerosol container 200 upside down, and the engaging projecting linear portion 66*c* and the inner peripheral surface of the mounting cup 203 are elastically engaged while the stem 205 is engaged within the gas spraying hole 67 to assume a pressed condition and thus a spraying condition of aerosol gas. In this manner, the degassing can be performed even in a hand-free condition by attaching the degassing tool 61 to the aerosol container 200.

Figure 19:
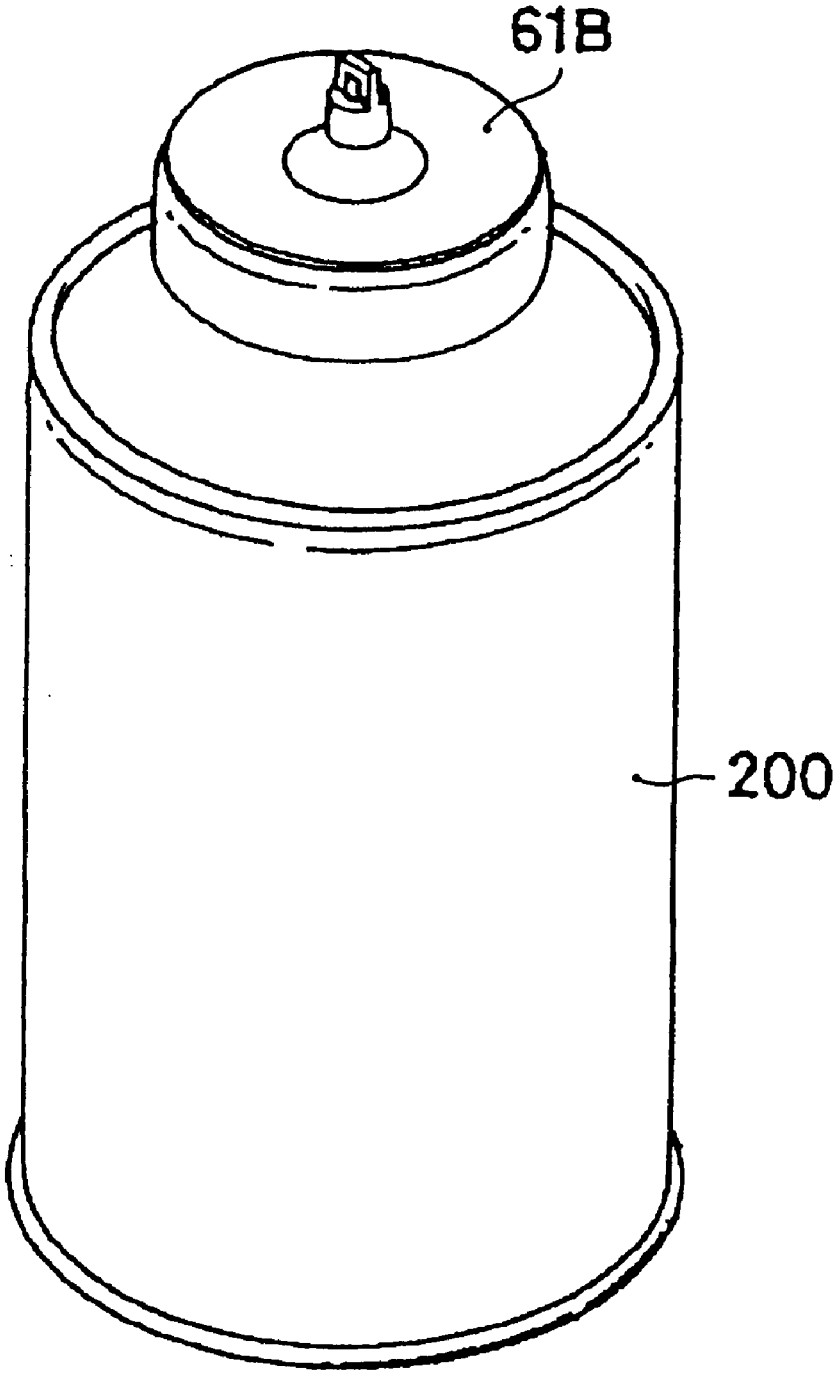
FIG. 19 is a perspective view showing a condition with the cutoff body of the degassing tool of FIG. 17 being attached to the aerosol container, that is, one example of an aerosol container ready for being dicarded.

For disposing of the degassed aerosol container 200, after completing the degassing in the above-described manner, the cutoff body 61B inward of the cutting line is separated from the degassing tool main body 61A along the cutting preparatory line 65 by pushing the aerosol container 200 further down as illustrated in FIG. 18(*b*), and the aerosol container 200 is pulled out from the degassing tool main body 61A together with the cutoff body 61B as illustrated in FIG. 18(*c*) to assume a condition as illustrated in FIG. 19 in which only the cutoff body 61B is attached to the aerosol container 200 so that the container can be discarded in this condition.

Though the degassing tool 61 does not have an indication for denoting a degassed condition 8 as is the case with the above-described degassing tool 1, it can still be apparently understood that the container has been degassed by seeing that the cutoff body 61B is attached thereto. Moreover, the aerosol container might be discarded with the stem being maintained in a pressed condition, and it is possible for everybody including persons engaged in the cleaning and garbage-collecting business to confirm with one's own eyes that the interior and exterior of the container are in a communicated condition, so that the collection of aerosol containers might be performed in an even more carefree manner.

Embodiment 5

Figure 20:
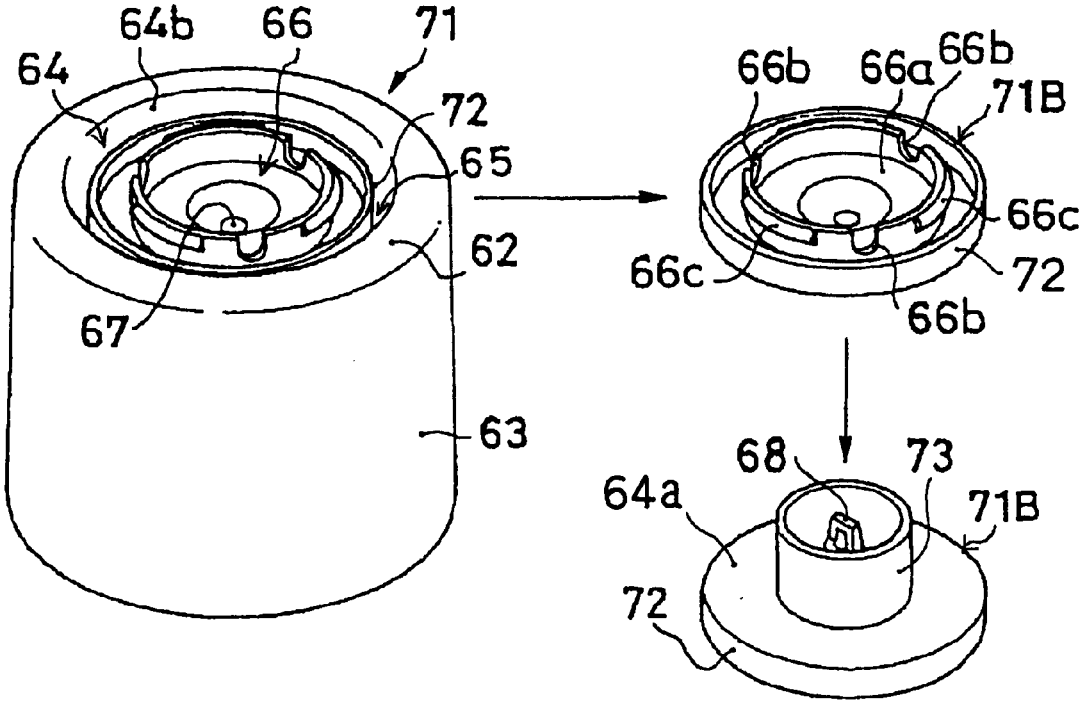
FIG. 20 is a perspective view showing a degassing tool according to a modified example of the degassing tool of FIG. 17 as well as a front surface side and a rear surface side of a part of the separated degassing tool, that is, the cutoff body.
Figure 21:
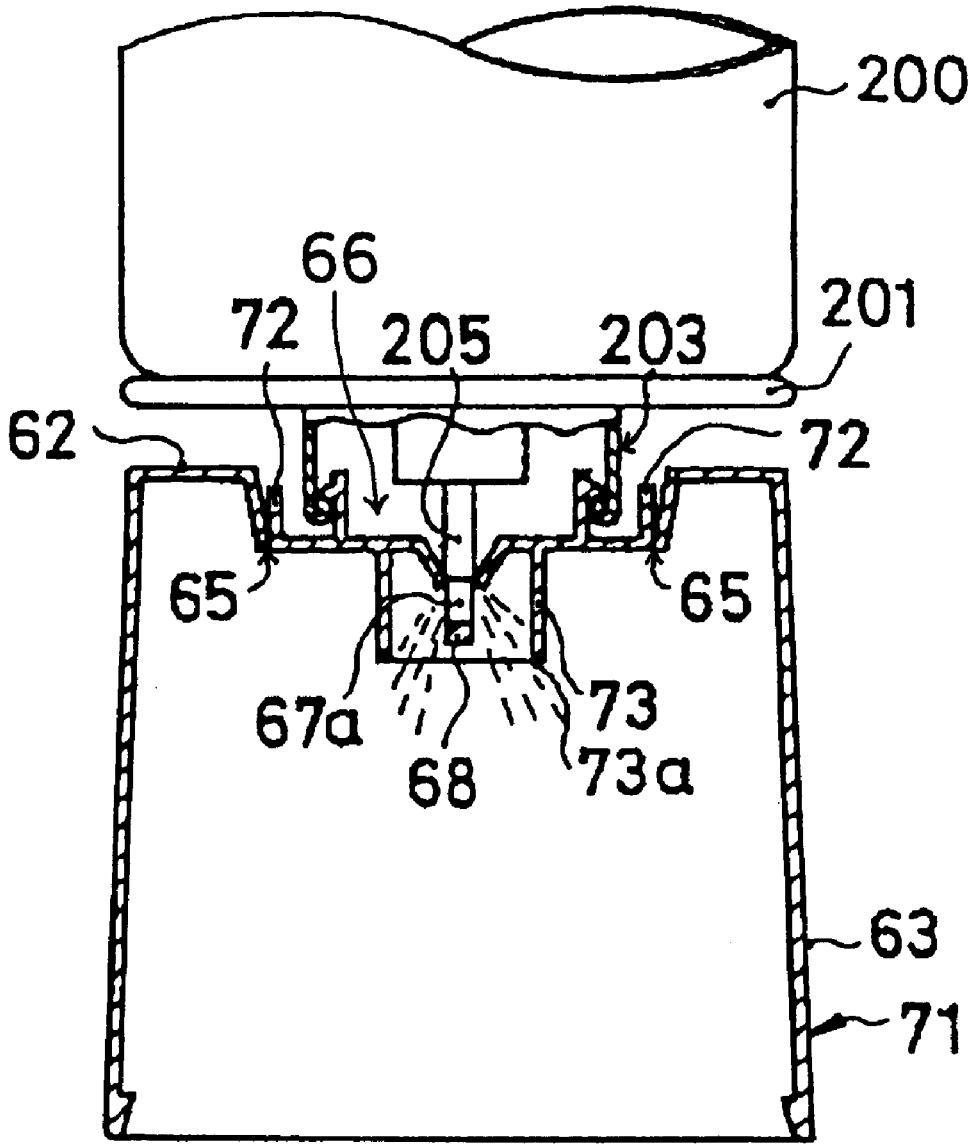
FIG. 21 is a sectional view showing a condition of the degassing tool of FIG. 17 being attached to the aerosol container.
Figure 22:
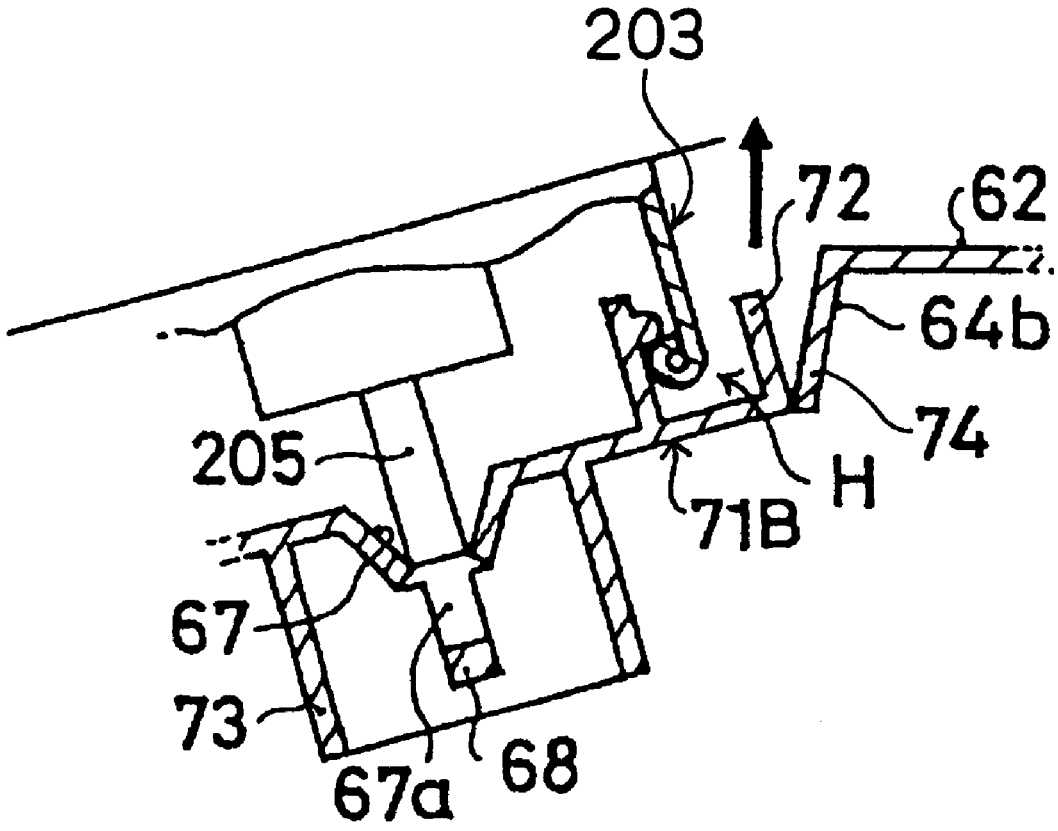
FIG. 22 is a sectional view showing a condition with the aerosol container being pulled out from the degassing tool together with the cutoff body upon completion of degassing for indicating functions of a wall portion of the degassing tool of FIG. 17.

A degassing tool 71 as illustrated in FIGS. 20 to 22 is a modified example of the above-described degassing tool 61, and as illustrated in FIGS. 20 and 21, the arrangement includes, besides the arrangement of the degassing tool 61, a wall portion 72 is provided upright along inside of the cutting preparatory line 65 and a shielding wall 73 is provided upright as to surround the tip end apertures of the gas spraying hole 67, that is, the gas spraying outlets 67*a* and the direction changing portion 68.

Figure 23:
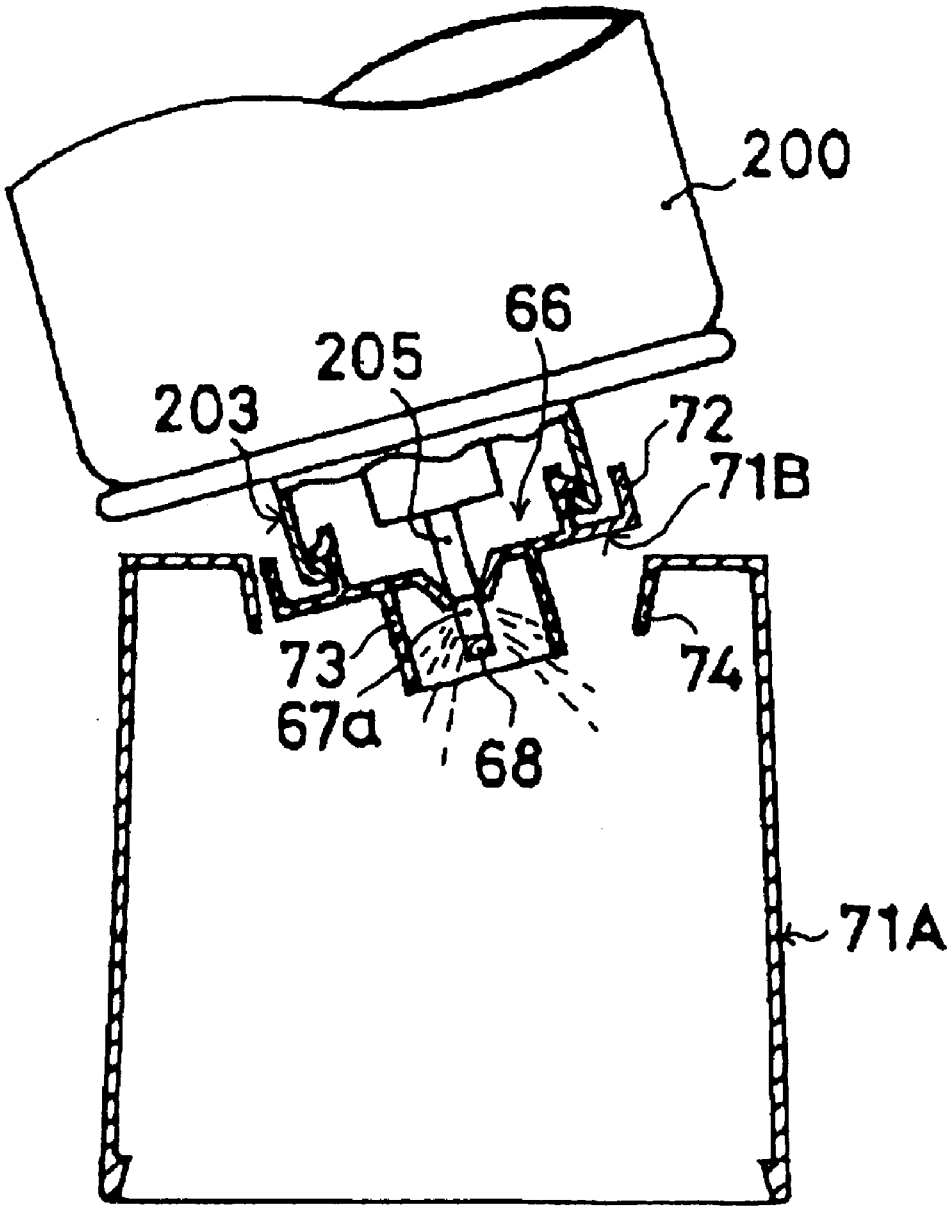
FIG. 23 is a sectional view showing a condition for performing degassing operations for indicating functions of a shielding wall of the degassing tool of FIG. 17.

The wall portion 72 is annularly erected to contact the inside of the cutting preparatory line 65, in other words, along a bottom edge of the concave depressed portion 64 or an erected edge of the inner peripheral wall surface 64*b* of the concave depressed portion 64, such that its height is at least less than a height of the cap top surface 62. More concretely, the cutting preparatory line 65 is formed along an erected edge portion of the wall portion 72, and by performing separation along the cutting preparatory line 65, at least a cutoff body 71B including the wall portion 72, the fitting concave portion 66 and the gas spraying hole 67 can be separated from a degassing tool main body 71A as illustrated in FIG. 23.

By the provision of the wall portion 72, it can be prevented that the cutoff body 71B comes off the aerosol container 200 at the time of pulling the aerosol container 200 out from the degassing tool main body 71A together with the cutoff body 71B upon completion of degassing. More concretely, in the absence of the wall portion 72, an uncut edge portion 74 in the degassing main body 71A will enter a clearance H formed between the cutoff body 71B and the mounting cup 203 and be caught thereat at the time of pulling the aerosol container 200 out together with the cutoff body 71B such that the cutoff body 71B might come off the aerosol container 200. However, by the provision of the wall portion 72, the wall portion 72 functions to hinder the entrance of the uncut edge portion 74 to thereby prevent the cutoff body 71B from coming off as illustrated in FIG. 22.

On the other hand, the shielding wall 73 annularly surrounds the gas spraying hole 67 projecting to inside of the cap, and an aperture edge portion 73*a* thereof is arranged on a bottom surface 64*a* of the concave depressed portion 64 to be located lower than at least the gas spraying hole 67*a* and the direction changing portion 68 as to surround these when the degassing tool 71 is turned down as illustrated in FIG. 21.

When the shielding wall 73 is provided in this manner, gas or contents sprayed out from the gas spraying outlet 67*a* as well as gas or contents sprayed out by hitting against the direction changing portion 68 will no more be discharged in a linear manner but will hit against an inner surface of the shielding wall 73. Consequently, also in case the aerosol container 200 is accidentally pulled out from the aperture of the degassing tool main body 71A surrounded by the uncut edge portion 74 during degassing operations, gas or contents will not be dynamically discharged to outside as illustrated in FIG. 23, so that it is possible to prevent gas or contents from being directly sprayed towards human face or the like, and safety can be further improved.

It is also possible to provide an indication for denoting a degassed condition 8 as is the case with the above-described degassing tool 1.

Embodiment 6

A degassing tool 81 as illustrated in FIGS. 24 to 32 is a degassing tool concurrently used as an aerosol cap with an indication for denoting a degassed condition which might be used as a cap for an aerosol container 100 and further as a degassing tool for the aerosol container 100 by turning the tool upside down.

Figure 24:
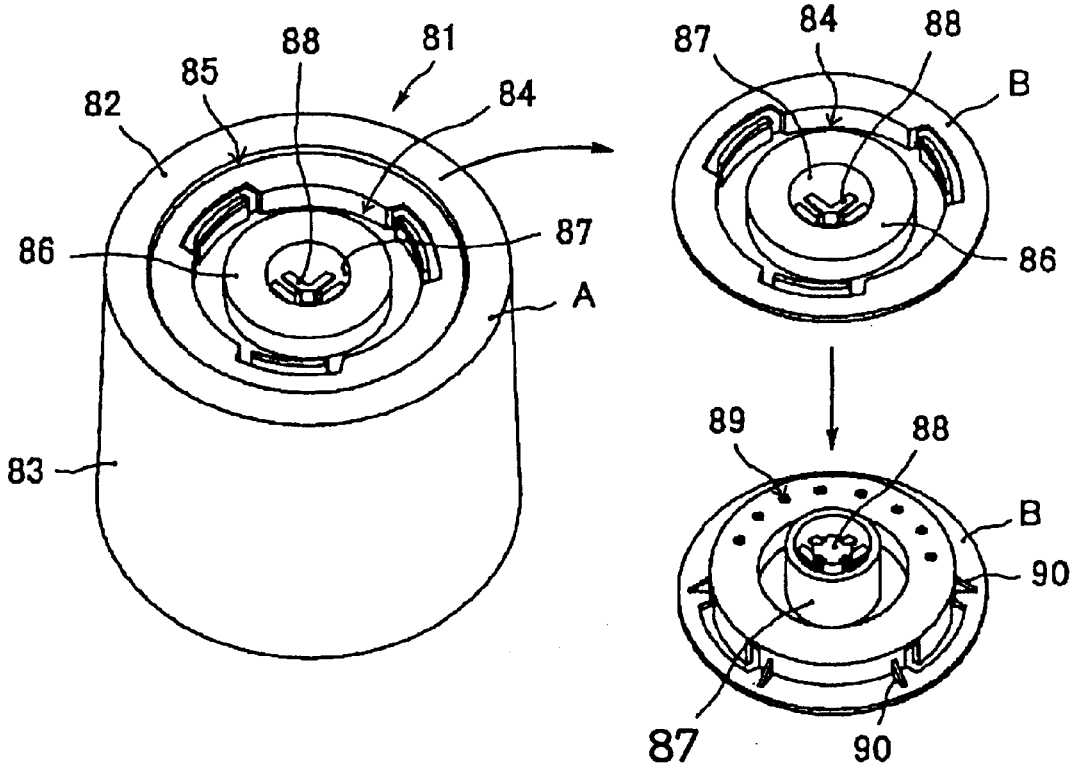
FIG. 24 is a perspective view showing a degassing tool according to another embodiment of a degassing tool as well as a front surface side and a rear surface side of a part of the separated degassing tool, that is, the cutoff body.
Figure 25:
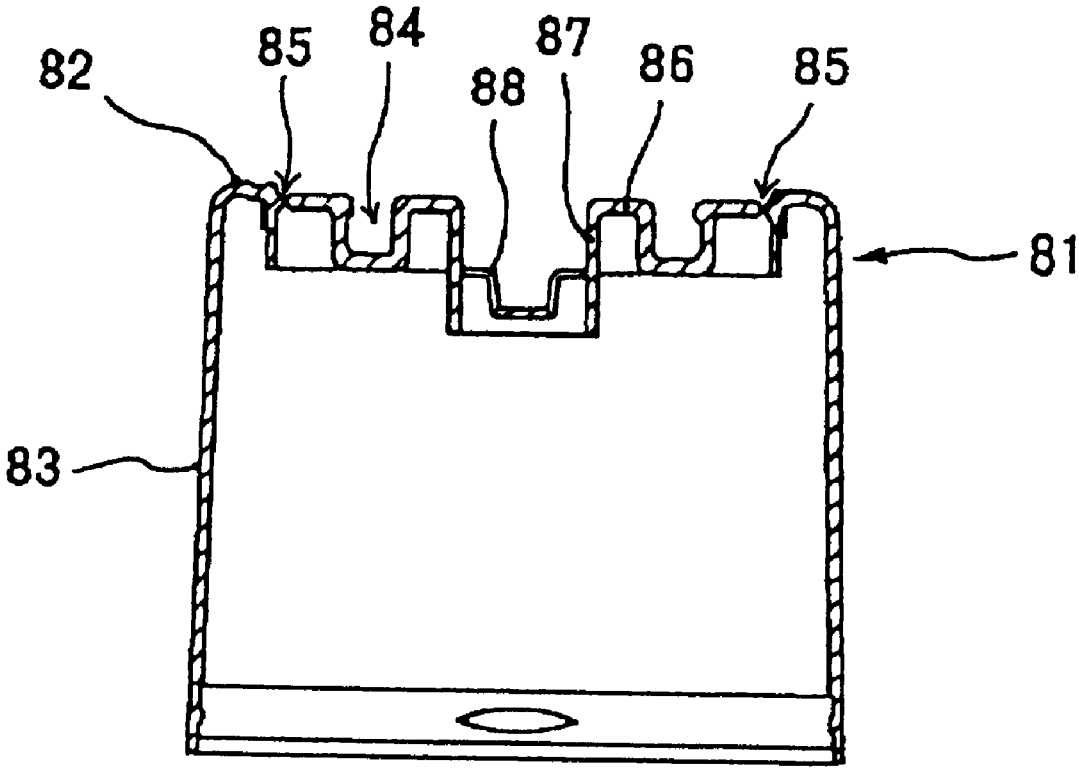
FIG. 25 is a sectional view of the degassing tool of FIG. 24.

The degassing tool 81 is integrally formed through injection molding of plastic, and as illustrated in FIG. 24, a bottomed cylindrical shape is formed by a cap top surface 82 and cap peripheral side surface 83, and a fitting concave portion 84 capable of being fit to an upper portion of the aerosol container 100 is formed on the cap top surface 82 while a cutting preparatory line 85 is formed to surround this fitting concave portion 84.

Figure 27:
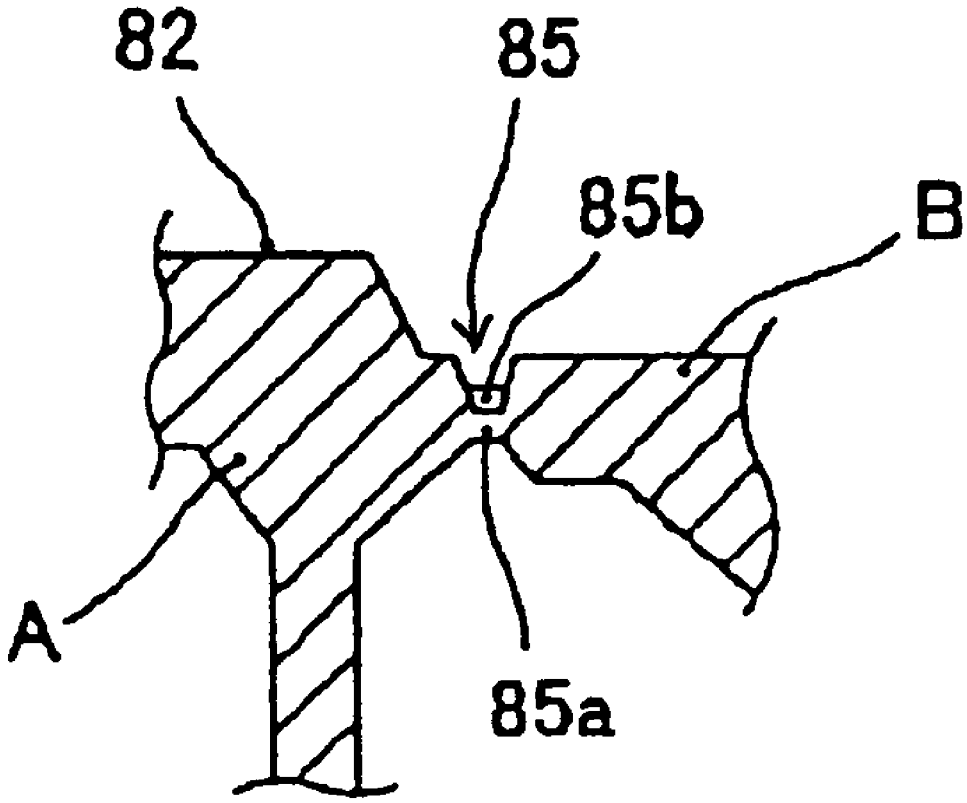
FIG. 27 is a enlarged sectional view showing a proximity to the cutting preparatory line of the degassing tool of FIG. 24.

The "bottomed cylindrical shape" and "fitting concave portion 84" are similarly formed as those of the above-described degassing tool 1. The "cutting preparatory line 85" is so arranged, as illustrated in FIG. 27, that a film-like thin portion 85*a* is formed over the entire periphery as to surround outside of an upper edge of the fitting concave portion 84 with thick portions 85*b* being provided within the thin portion 85*a* at suitable intervals. By cutting along this cutting preparatory line 85, it is possible to separate an inside portion of the cutting preparatory line 85 (cutoff body B) from degassing tool main body A. At this time, the cutoff body B can be reliably separated from the degassing tool main body A since the thin portion 85*a* is formed to extend over the entire periphery. Moreover, while the provision of merely the thin portion 85*a* might result in cases in which this portion is stretched and hard to be separated when the degassing tool is attached to the aerosol container 100, the provision of thick portions 85*b* at suitable intervals makes it still easier to perform separation.

An annular projecting portion 86 is formed in a bottom surface of the fitting concave portion 84, projecting as far as substantially the height of the cap top surface 82, and a cylindrical portion 87 is provided inside of the annular projecting portion 86 as to project inward of the cap with a stem inserting portion 88 being provided within the cylindrical portion 87.

Figure 26:
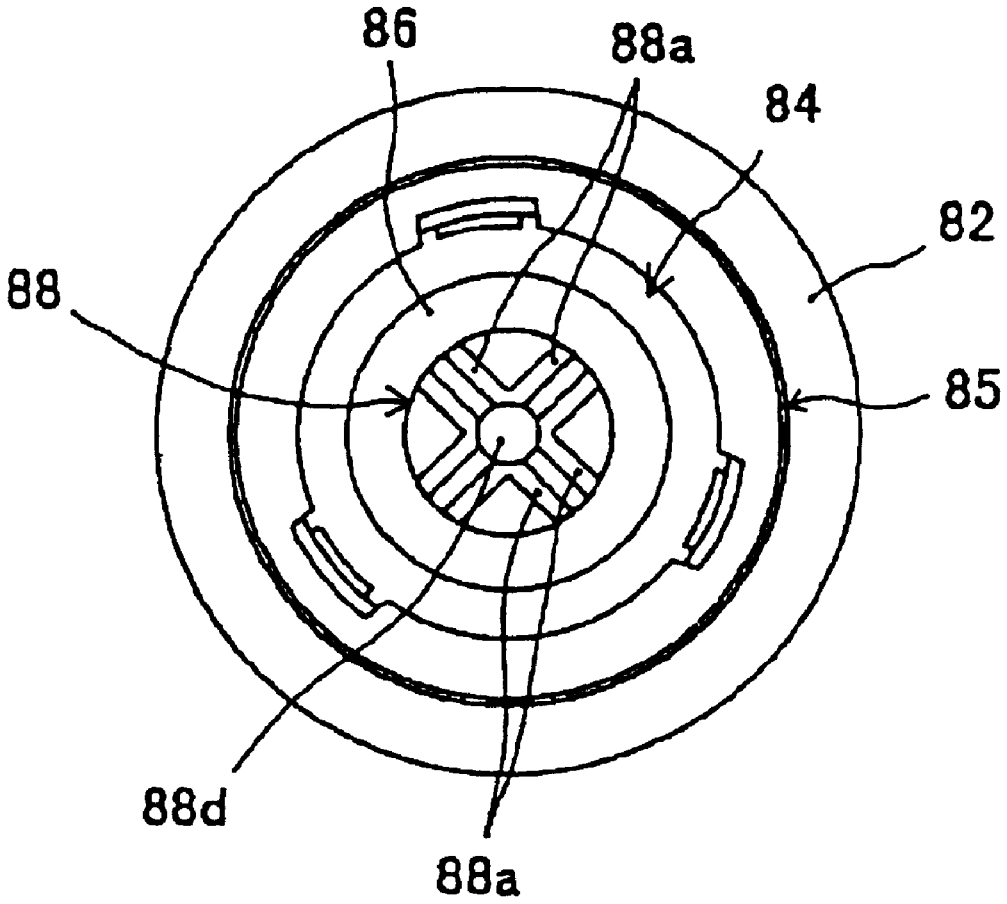
FIG. 26 is an upper surface view of the degassing tool of FIG. 24.
Figure 28:
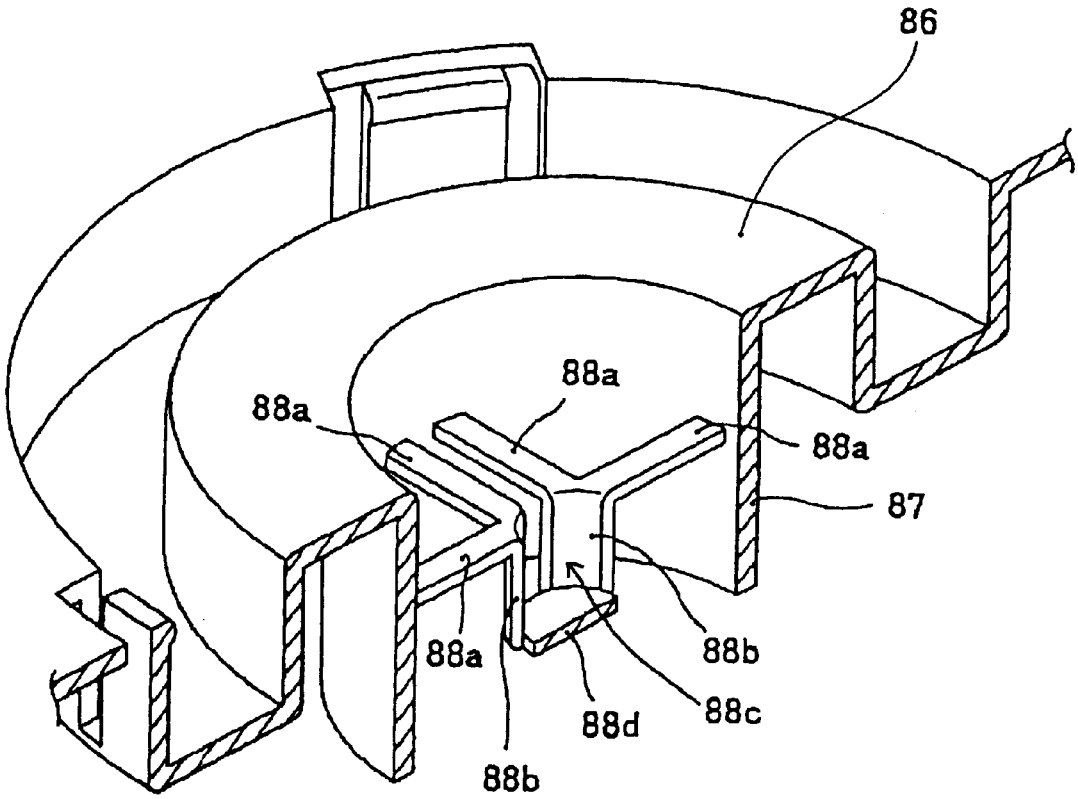
FIG. 28 is a partial sectional perspective view showing an arrangement of a stem-inserting portion of the degassing tool of FIG. 24.

As illustrated in FIGS. 26 and 28, the stem inserting portion 88 is so arranged that, in a proximity to an intermediate portion in the axial direction within the cylindrical portion 87, two linear or thin plate-like arm portions 88*a*, 88*a*, which are arranged parallel with respect to each other with suitable distances formed between, are made to respectively jut out rapidly and inwardly from four points of the inner peripheral surface of the cylindrical body, joined to either one of adjoining arm portion 88*a* of the other pair in a proximity to the central portion, and bend inward of the cap in the axial direction such that these bend portions 88*b*, 88*b*, 88*b*, 88*b* form an axial hole portion 88*c* having a diameter which is identical with or somewhat larger than the diameter of the tip end portion of the stem 105, while a tip end portion of this axial hole portion 88*c* is further provided with a bottom surface portion 88*d* as to cross the axial direction.

Owing to this arrangement of the stem inserting portion 88, the tip end portion of the stem 105, when inserted into the axial hole portion 88*c*, is engaged at the intermediate portion in the axial direction of the axial hole portion 88*c* or at the bottom surface portion 88*d* such that the stem 105 assumes a pressed condition. At this time, each of the arm portions 88*a* are allowed to stretch to some extent since they are of linear or thin plate-like shape and the bottom surface portion 88*d* might be somewhat flexed as well, so that it is possible to accommodate differences in lengths of stems 105 among containers owing to the stretch of the arm portions 88*a* and the flex of the bottom surface portion 88*d*.

Gas or contents sprayed out from the tip end of the stem 105 is sprayed in lateral directions from clearances formed between adjoining bend portions 88*b*, 88*b* while hitting or without hitting against the bottom surface portion 88*d*, but is arranged not be sprayed in the axial direction of the stem inserting portion 88.

An indication for denoting a degassed condition 89 similarly to the indication for denoting a degassed condition 8 is provided at the bottom surface of the fitting concave portion 84, and triangular platelike ribs 90 are arranged at suitable intervals in the circumferential direction at parts from which the fitting concave portion 84 is erecting from the cap top surface 82.

Figure 29B:
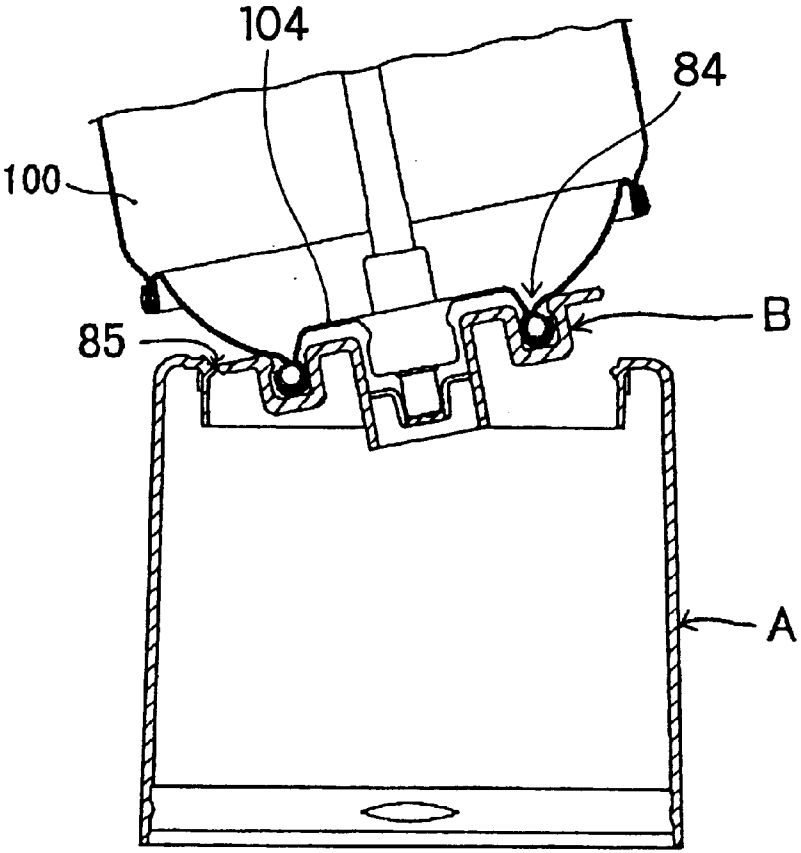
FIGS. 29(*a*) and 29(*b*) are sectional views wherein FIG. 29(*a*) wherein (a) illustrates a condition for performing degassing by using the degassing tool of FIG. 24 and FIG. 29(*b*) a condition with the aerosol container being pulled out from the degassing tool together with the cutoff body upon completion of degassing.
Figure 29A:
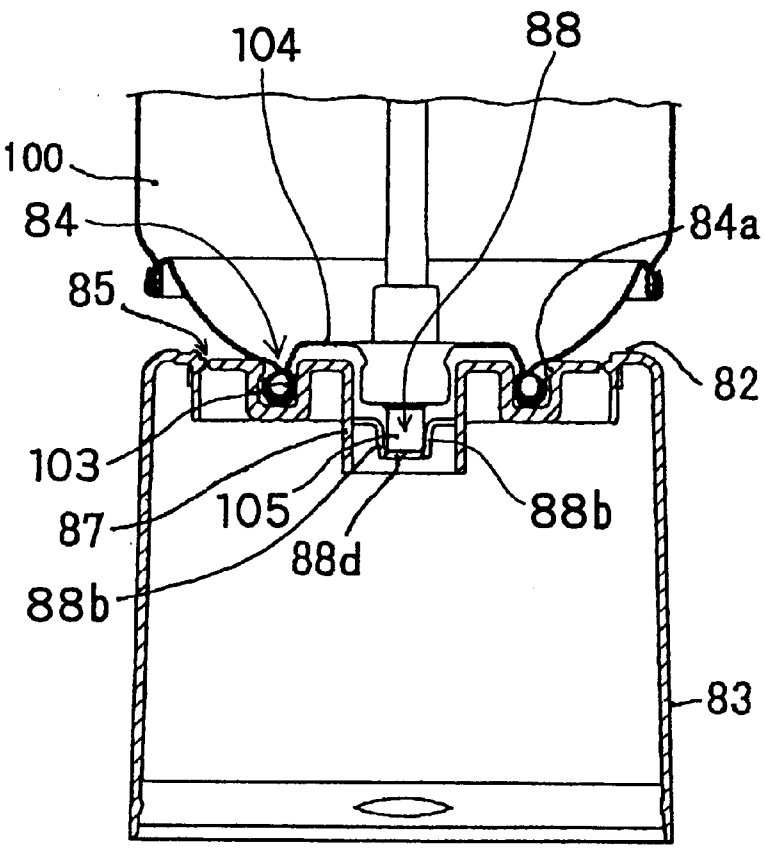

The above-described arrangement of the degassing tool 81 enables it to use the tool as an aerosol cap in normal conditions, and if one should wish to perform degassing, the degassing tool 81 is turned down as illustrated in FIG. 29(*a*), a joining portion between the bead portion 103 and the mounting cup 104 is inserted into the fitting concave portion 84, and while inserting the stem 105 into the stem inserting portion 88, the outer peripheral surface of the mounting cup 104 is engaged with the engaging portion 84*a* of the fitting concave portion 84. In this manner, the tip end portion of the stem 105 is engaged at the intermediate portion in the axial direction of the stem inserting portion 88 or the bottom surface portion 88*d* to assume a pressed condition so that contents might be sprayed. At this time, sprayed gas or contents is sprayed in lateral directions from clearances formed between adjoining bend portions 88*b*, 88*b* while hitting or without hitting against the bottom surface portion 88*d* and hits against the inner peripheral surface of the cylindrical portion 87. Thus, the cylindrical portion 87 exhibits functions and effects similar to those of the above-described shielding wall 73.

Figure 30:
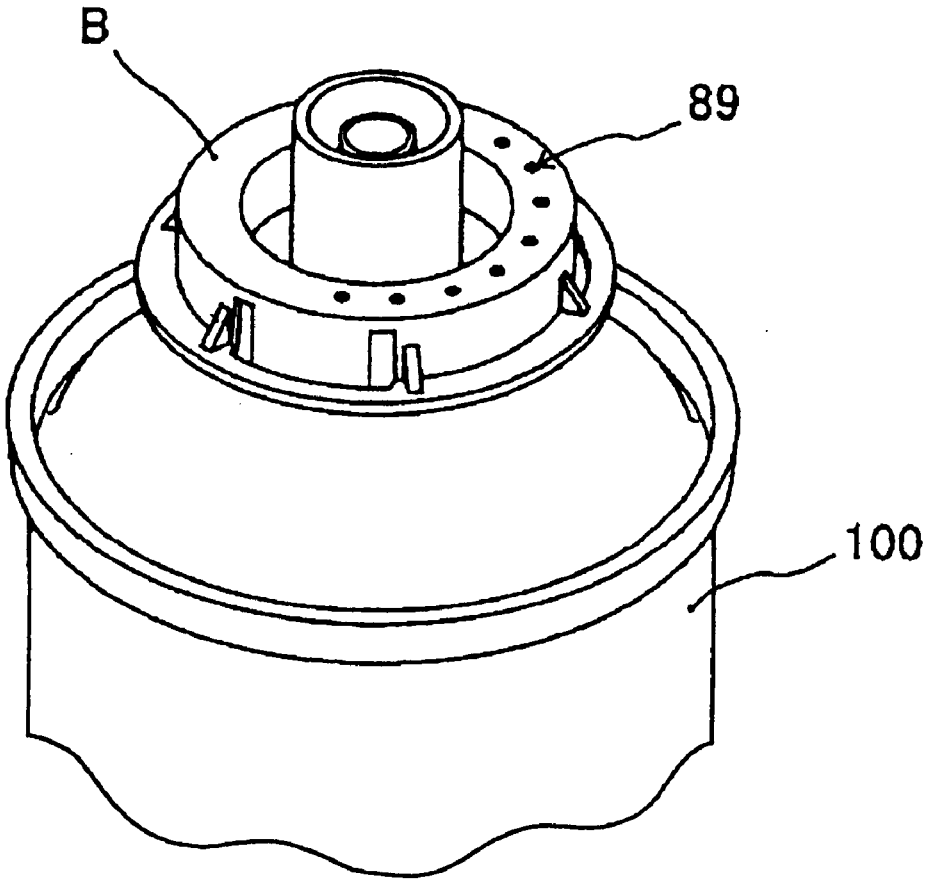
FIG. 30 is a perspective view showing a condition with the cutoff body of the degassing tool of FIG. 24 being attached to the aerosol container, that is, an example of the aerosol container ready for being dicarded.

For disposal of the aerosol container 100, after completing degassing in the above-described manner, the portion inward of the cutting line (that is, the cutoff body B) is separated from the degassing tool main body A along the cutting preparatory line 85 through reversing or the like with the outer peripheral surface of the mountain cup being remained fitted at the fitting concave portion 84 as illustrated in FIG. 29(*b*) to assume a condition in which only the cutoff body B is attached to the aerosol container 100 as illustrated in FIG. 30. At this time, the cutoff body B includes the fitting concave portion, the stem inserting portion and the indication denoting a degassed condition 89 such that the indication denoting a degassed condition 89 is positioned at the outer surface side, so that this indication can be apparently be recognized by everybody. The fit condition between the fitting concave portion and the outer peripheral surface of the mounting cup is maintained and the stem is maintained in a pressed condition, that is, in which the interior of the container and the exterior are communicated.

Figure 31:
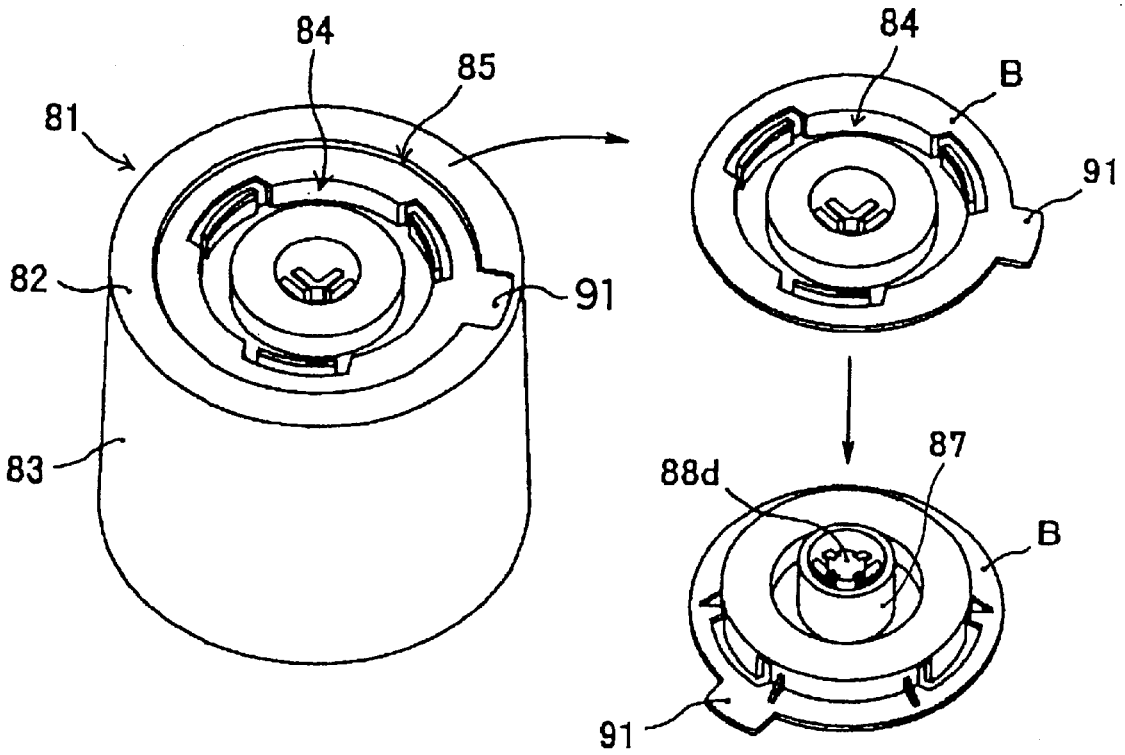
FIG. 31 is a perspective view showing a degassing tool according to a modified example of the degassing tool of FIG. 24 as well as a front surface side and a rear surface side of a part of the separated degassing tool, that is, the cutoff body.
Figure 32:
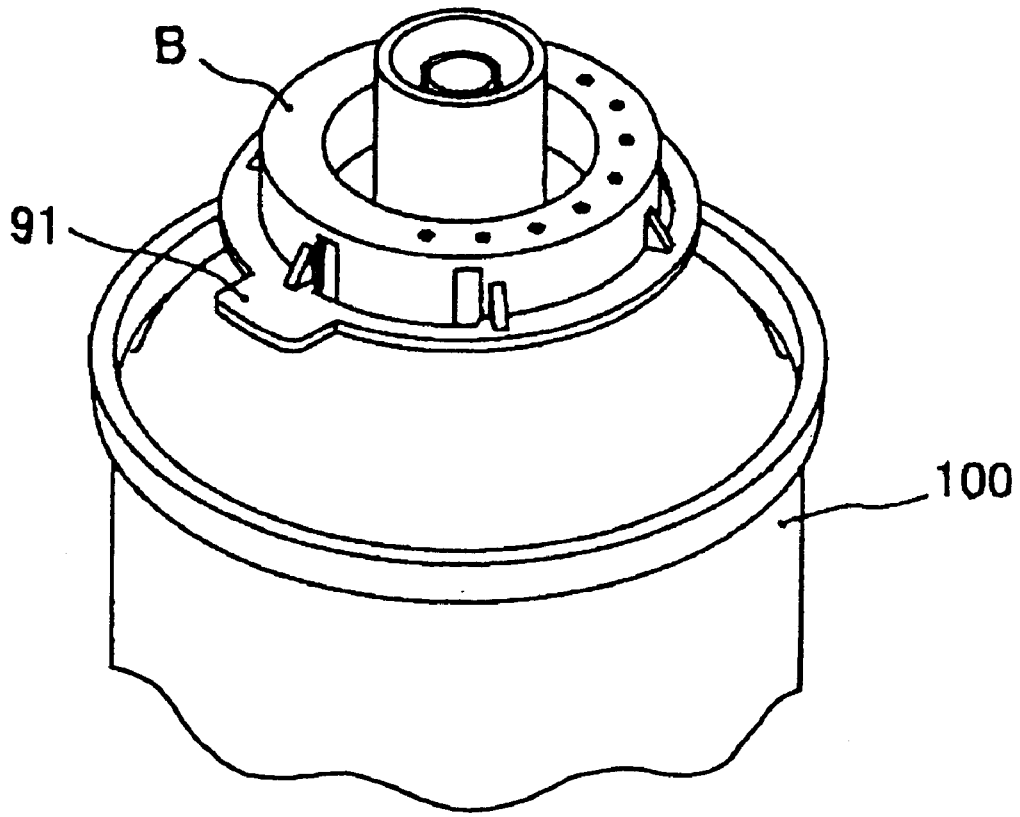
FIG. 32 is a perspective view showing a condition with the cutoff body of the degassing tool of FIG. 31 being attached to the aerosol container, that is, an example of the aerosol container ready for being discarded.

It should be noted that the above-described degassing tool 81 might also be so arranged that the cutting preparatory line 85 is formed to partially project outside as illustrated in FIG. 31 (projecting portion 85*a*) so that a gripping piece 91 is provided at an edge portion of the cutoff body B as illustrated in FIG. 32. In this manner, it is possible to obtain an arrangement in which the cutoff body B can be easily detached from the aerosol container 100 by grasping and pulling the gripping piece 91 even if degassing operations have been erroneously performed.

What is claimed is:

1. An arrangement for indicating a degassed condition of an aerosol container wherein a degassing tool or a part thereof is attached to a degassed aerosol container such that a stem of the aerosol container is maintained in a pressed condition, and wherein it is indicated on an outer surface of the degassing tool or the part thereof by either a marking on or a shaping of the outer surface that degassing has been completed.

2. The arrangement for indicating a degassed condition of an aerosol container of claim 1, wherein the part of the degassing tool is designed to be separable from the degassing tool during or after degassing.

3. The arrangement for indicating a degassed condition of an aerosol container of claim 1, wherein the degassing tool or the part thereof with an indication denoting a degassed condition is formed of a material of the same group as that of the aerosol container.

4. An arrangement for indicating a degassed condition of an aerosol container wherein an indicating body with an indication denoting a degassed condition is engaged and attached to the aerosol container in a degassed condition, the indication provided by either a marking on or a shaping of a surface of the indicating body.

5. A method for indicating a degassed condition of an aerosol container comprising:

performing degassing by attaching a degassing tool with an indication denoting a degassed condition on an outer surface of the degassing tool to the aerosol container and by maintaining a stem of the aerosol container in a pressed condition, and maintaining an attached condition of the degassing tool after completion of degassing to indicate that degassing has been completed, wherein the indication denoting a degassed condition is provided by either a marking on or a shaping of a surface of the degassing tool.

6. A method for indicating a degassed condition of an aerosol container comprising:

performing degassing by attaching a degassed condition on an outer surface of a degassing tool to the aerosol container and by maintaining a stem of the aerosol container in a pressed condition, and separating a part of the degassing tool therefrom during degassing or after completion of degassing, and maintaining an attached condition of the part of the remained degassing tool to indicate that degassing has been completed by the indication denoting a degassed condition on an outer surface of the part of the degassing tool, wherein the indication denoting a degassed condition is provided by either a marking on or a shaping of a surface of the degassing tool.

7. The method for indicating a degassed condition of an aerosol container of claim 5, wherein the stem is maintained in a pressed condition and it is indicated that degassing has been completed by attaching the degassing tool or the part of the degassing tool to the aerosol container.

8. A method for indicating a degassed condition of an aerosol container comprising:

attaching an indicating body with an indication denoting a degassed condition to a degassing tool in a separable manner, engaging and attaching the indicating body to the aerosol container simultaneously with performing degassing of the aerosol container by using the degassing tool, separating the degassing tool from the aerosol container upon completion of degassing, and indicating a degassed condition by the indicating body engaged at the aerosol container, wherein the indication denoting a degassed condition is provided by either a marking on or a shaping of a surface of the degassing tool.

9. A degassing tool for an aerosol container with which the aerosol container can be maintained in a spraying condition when the tool is attached to the aerosol container, the tool having an indication denoting a degassed condition on a portion constituting the outer surface when the tool is attached to the aerosol container, wherein the indication denoting a degassed condition is provided by either a marking on or a shaping of a surface of the degassing tool.

10. The degassing tool for an aerosol container of claim 9, wherein the portion with an indication denoting a degassed condition is made separable from the entire degassing tool.

11. The degassing tool for an aerosol container of claim 9, wherein the portion with an indication denoting a degassed condition includes an engaging portion with which a stem can be maintained in a pressed condition at the time the tool is engaged with an aerosol container, and a gas spraying hole.

12. The degassing tool for an aerosol container of claim 9, wherein at least the portion with an indication denoting a degassed condition is formed of a material of the same group as that of the aerosol container.

13. A degassing tool for an aerosol container including an engaging portion with which a stem can be maintained in a pressed condition at the time the tool is engaged with an aerosol container, and a gas spraying hole, the aerosol container being maintained in a spraying condition when the tool is attached to the aerosol container, wherein a cutting preparatory line is formed to surround the engaging portion to enable at least a portion including the engaging portion to be separable from a degassing tool main body.

14. The degassing tool for an aerosol container of claim 13, wherein the cutting preparatory line is formed by providing a film-like thin portion over the entire periphery of the engaging portion and thick portions within the thin portion at suitable intervals in a circumferential direction.

15. The degassing tool for an aerosol container of claim 13, wherein a wall portion is provided upright along inside of the cutting preparatory line.

16. The degassing tool for an aerosol container of claim 13, wherein a shielding wall is provided to surround the gas spraying hole.

17. The arrangement of claim 2, wherein the degassing tool or the part thereof with an indication denoting a degassed condition is formed of a material of the same group as that of the aerosol container.

18. The method of claim 6, wherein the stem is maintained in a pressed condition and it is indicated that degassing has been completed by attaching the degassing tool or the part of the degassing tool to the aerosol container.

19. The tool of claim 10, wherein the portion with an indication denoting a degassed condition includes an engaging portion with which a stem can be maintained in a pressed condition at the time the tool is engaged with an aerosol container, and a gas spraying hole.

20. The tool of claim 10, wherein at least the portion with an indication denoting a degassed condition is formed of a material of the same group as that of the aerosol container.

21. The tool of claim 20, wherein at least the portion with an indication denoting a degassed condition is formed of a material of the same group as that of the aerosol container.

22. The tool of claim 11, wherein the portion with an indication denoting a degassed condition includes an engaging portion with which a stem can be maintained in a pressed condition at the time the tool is engaged with an aerosol container, and a gas spraying hole.

23. The tool of claim 14, wherein a wall portion is provided upright along inside of the cutting preparatory line.

24. The tool of claim 23, wherein a shielding wall is provided to surround the gas spraying hole.

25. The tool of claim 14, wherein a shielding wall is provided to surround the gas spraying hole.

26. The tool of claim 15, wherein a shielding wall is provided to surround the gas spraying hole.

* * * * *

UNITED STATES PATENT AND TRADEMARK OFFICE

CERTIFICATE OF CORRECTION

PATENT NO. : 6,382,473 B1
DATED : May 7, 2002
INVENTOR(S) : Satoshi Mekata and Kouji Nomiyama It is certified that error appears in the above-identified patent and that said Letters Patent is hereby corrected as shown below:

Column 1,
Line 33, after "entire" insert -- contents of --.
Line 43, before "really" insert -- have --.

Column 5,
Line 15, "(b)" should be -- Fig 11(b) --.
Line 45, "Fig. (a)" should be -- Fig. 18(a) --.

Column 6,
Line 20, delete "wherein a".

Column 10,
Line 45, "11a and 11b" should be -- 11(a) and 11(b) --.
Line 46, after "11(a)", insert -- and --.

Column 14,
Line 58, "8(a)" should be -- 18(a) --.

Signed and Sealed this

Fourteenth Day of January, 2003

JAMES E. ROGAN
*Director of the United States Patent and Trademark Office*